US010987964B2

(12) United States Patent
Noguchi

(10) Patent No.: US 10,987,964 B2
(45) Date of Patent: Apr. 27, 2021

(54) POST-PROCESSING APPARATUS

(71) Applicant: FUJI XEROX CO., LTD., Tokyo (JP)

(72) Inventor: Jun Noguchi, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 352 days.

(21) Appl. No.: 16/051,778

(22) Filed: Aug. 1, 2018

(65) Prior Publication Data

US 2019/0291496 A1 Sep. 26, 2019

(30) Foreign Application Priority Data

Mar. 22, 2018 (JP) ..... JP2018-055080
Mar. 22, 2018 (JP) ..... JP2018-055081
Mar. 22, 2018 (JP) ..... JP2018-055082
Mar. 22, 2018 (JP) ..... JP2018-055083

(51) Int. Cl.
*B42C 1/12* (2006.01)
*B65H 29/12* (2006.01)
*B65H 37/04* (2006.01)

(52) U.S. Cl.
CPC ..... *B42C 1/12* (2013.01); *B65H 29/12* (2013.01); *B65H 37/04* (2013.01)

(58) Field of Classification Search
CPC ..... B42C 1/12; B65H 29/12; B65H 37/04
See application file for complete search history.

(56) References Cited

U.S. PATENT DOCUMENTS 9,126,794 B2 * 9/2015 Abe ..... B65H 5/068
2002/0008350 A1 * 1/2002 Adachi ..... B65H 31/36 271/213
2013/0214470 A1 * 8/2013 Yokomizo ..... B42B 5/10 270/1.01
2015/0183610 A1 * 7/2015 Matsuki ..... B65H 9/10 270/58.08
2019/0291497 A1 * 9/2019 Matsumoto ..... B65H 43/00

FOREIGN PATENT DOCUMENTS

JP 2015-016640 A 1/2015
JP 2015009966 A * 1/2015
JP 2017132640 A * 8/2017

* cited by examiner

*Primary Examiner* — David H Banh
(74) *Attorney, Agent, or Firm* — Oliff PLC

(57) ABSTRACT

A post-processing apparatus includes: a first binding unit that binds sheets and moves while rotating a first gear; a second binding unit that binds sheets and moves while rotating a second gear; a common path that is a path along which the first binding unit and the second binding unit move; a first rack gear that is provided along the common path and meshes with the first gear; and a second rack gear that is provided along the common path at a side opposite to the first rack gear with the common path interposed between the second rack gear and the first rack gear, and meshes with the second gear.

19 Claims, 16 Drawing Sheets

POST-PROCESSING APPARATUS

CROSS-REFERENCE TO RELATED APPLICATIONS

This application is based on and claims priority under 35 USC 119 from Japanese Patent Application No. 2018-055083 filed Mar. 22, 2018, Japanese Patent Application No. 2018-055080 filed Mar. 22, 2018, Japanese Patent Application No. 2018-055081 filed Mar. 22, 2018, and Japanese Patent Application No. 2018-055082 filed Mar. 22, 2018.

BACKGROUND

(i) Technical Field

The present disclosure relates to a post-processing apparatus and an image forming system.

(ii) Related Art

JP-A-2015-16640 discloses that a first binding tool, a second binding tool, and the like are provided to bind a bundle of sheets, a connecting member, which is connected to one of the multiple binding tools, is provided, a switching mechanism, which switches the binding tool that connects to the connecting member, is provided, and the binding tool, which connects to the connecting member, is switched by the switching mechanism. In addition, Patent Document 1 discloses that binding processing is performed on multiple points of the bundle of sheets by drawing the binding tool connected to the connecting member by moving the connecting member in parallel with a sheet surface.

In the configuration in which the multiple binding units are provided, paths along which the binding units move sometimes overlap one another. In addition, for example, there is a configuration that moves a binding unit by operating the binding unit with a belt. Here, in some instances, there is a limitation in terms of layouts such as interference between the belt and other members, for example, when making the paths of the binding units close to one another by operating the belt.

In the configuration in which the multiple binding units are provided, the paths along which the multiple binding units move branches off, in some instances, in order to switch the binding units, for example. Further, there is a technology of providing a movable dividing member for switching the paths along which the binding units travel, at a branching-off point from which the paths branch off, but in this technology, switching control of the dividing member is required.

In a configuration in which the path along which the binding unit moves has a curved portion, it is possible to inhibit a dimension of a region through which the binding unit passes, for example, by increasing a curvature of the curved portion. However, when the curved portion has a large curvature, it is impossible to stably change a direction of the binding unit, in some instances, in comparison with a case in which the curved portion has a small curvature.

There is a technology that forms a groove for guiding a binding unit and moves the binding unit along the groove. In addition, in a case in which this technology adopts a configuration in which the groove is divided, a part of the binding unit falls into the groove when the binding unit passes the branching-off point, which makes it impossible for the binding unit to move, in some instances.

SUMMARY

Aspects of non-limiting embodiments of the present disclosure relate to providing a post-processing apparatus and the like capable of moving respective binding units while making movement paths of the multiple binding units close to each other.

Aspects of non-limiting embodiments of the present disclosure also relate to providing a post-processing apparatus and the like capable of switching paths along which binding units travel even in a case in which no movable dividing member is provided at a branching-off point.

Aspects of non-limiting embodiments of the present disclosure further relate to providing a post-processing apparatus and the like in which an operation of changing a direction of a binding unit is assisted when the binding unit passes a curved portion.

Aspects of non-limiting embodiments of the present disclosure further relate to restricting a movement of a binding unit from being disabled when the binding unit passes a branching-off point.

Aspects of certain non-limiting embodiments of the present disclosure overcome the above disadvantages and other disadvantages not described above. However, aspects of the non-limiting embodiments are not required to overcome the disadvantages described above, and aspects of the non-limiting embodiments of the present disclosure may not overcome any of the problems described above.

According to an aspect of the present disclosure, there is provided a post-processing apparatus including: a first binding unit that binds sheets and moves while rotating a first gear; a second binding unit that binds sheets and moves while rotating a second gear; a common path that is a path along which the first binding unit and the second binding unit move; a first rack gear that is provided along the common path and meshes with the first gear; and a second rack gear that is provided along the common path at a side opposite to the first rack gear with the common path interposed between the second rack gear and the first rack gear, and meshes with the second gear.

BRIEF DESCRIPTION OF THE DRAWINGS

Exemplary embodiments of the present disclosure will be described in detail based on the following figures, wherein.

DETAILED DESCRIPTION

Hereinafter, exemplary embodiments of the present disclosure will be described with reference to the accompanying drawings.

<Image Forming System 100>

Figure 1:
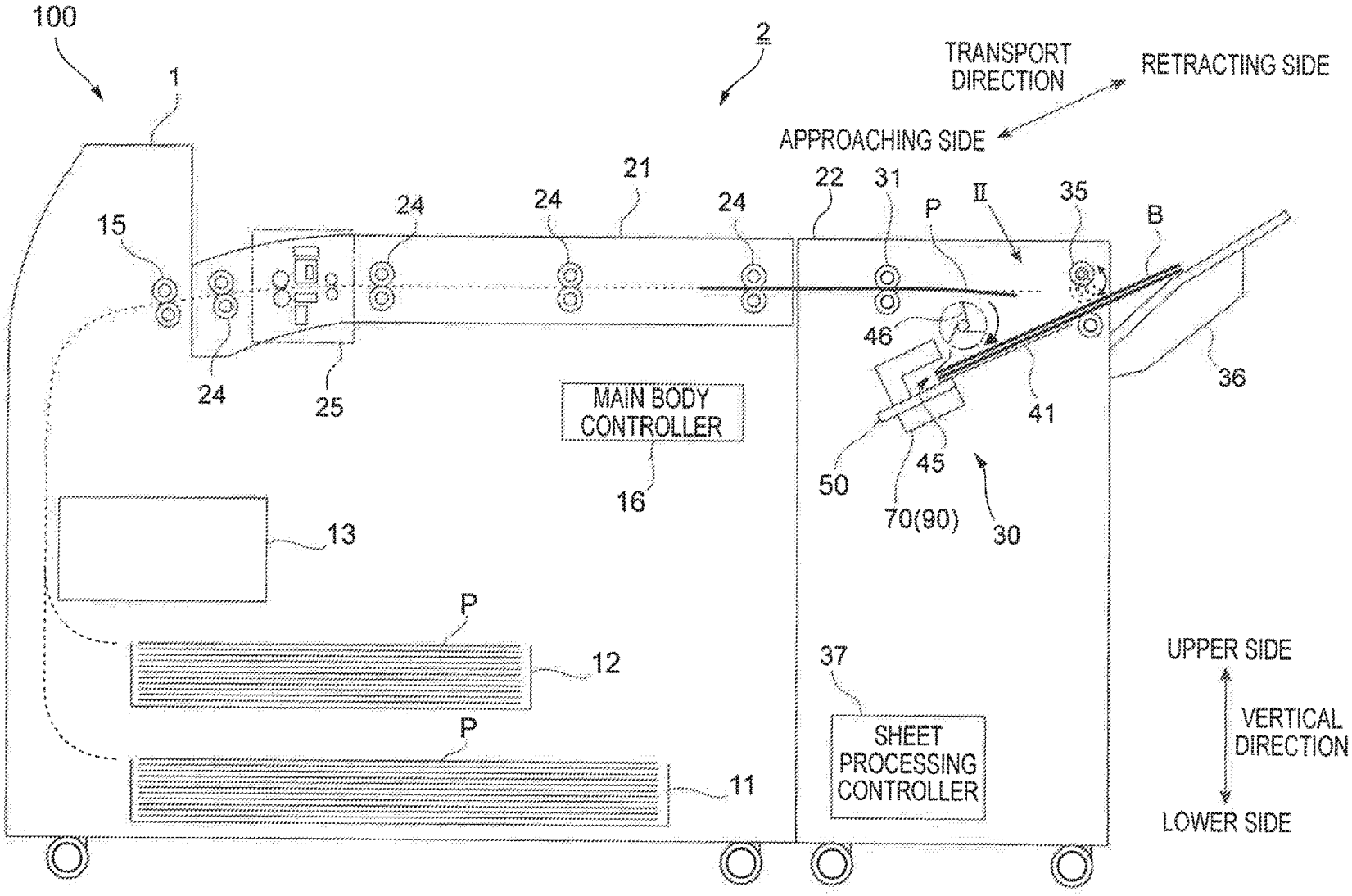
FIG. 1 is a view illustrating a configuration of an image forming system applied to which the present exemplary embodiment is applied.

FIG. 1 is a view illustrating a configuration of an image forming system 100 to which the present exemplary embodiment is applied. The image forming system 100 has an image forming apparatus 1 which forms an image on a recording medium (sheet) such as a sheet P by using an electrophotographic process or the like, and a post-processing apparatus 2 which performs post-processing on the multiple sheets P on which images are formed by the image forming apparatus 1.

In the following description, an up and down direction (vertical direction) in FIG. 1 is sometimes simply referred to as a "vertical direction". In addition, an upper side in the vertical direction in FIG. 1 is also simply referred to as an "upper side", and a lower side in the vertical direction is sometimes simply referred to as a "lower side". In addition, a depth direction of a page surface in the image forming system 100 illustrated in FIG. 1 is sometimes simply referred to as a "width direction". In addition, a front side of the page surface in FIG. 1 is sometimes simply referred to as a "front side", and a depth side of the page surface is sometimes simply referred to as a "rear side".

<Image Forming Apparatus 1>

The image forming apparatus 1 has sheet accommodating units 11 and 12 which accommodate the sheets P, an image forming unit 13 which forms an image on the sheet P, discharge rollers 15 which discharge the sheet P on which the image is formed, and a main body controller 16 which controls an operation of the image forming apparatus 1.

The sheet accommodating units 11 and 12 accommodate the sheets P having different sizes or types. In the illustrated example, the sheet accommodating units 11 and 12 may be drawn toward the front side of the page surface, that is, toward the front side in the width direction. Further, an operation of supplementing the sheet accommodating units 11 and 12 with the sheets P is performed by a user or the like in a state where the sheet accommodating units 11 and 12 are drawn.

The image forming unit 13 forms images on the sheets P transported from the sheet accommodating units 11 and 12. In the illustrated example, the image forming unit 13 forms the image on the sheet P through an electrophotographic process of forming an image by transferring toner, which is attached to a photoconductor, onto the sheet P, but the image forming unit 13 may form an image through an inkjet process of forming an image by ejecting ink onto the sheet P.

The discharge rollers 15 discharge the sheet P on which the image is formed by the image forming unit 13. In the illustrated example, the discharge rollers 15 include a pair of rolls, and the sheet P is discharged from the image forming apparatus 1 as the pair of rolls rotates.

The main body controller 16 controls operations of the constituent members provided in the image forming apparatus 1. In addition, in the illustrated example, the main body controller 16 outputs an instruction signal intended to instruct the post-processing apparatus 2 to process the sheet P.

Here, an operation of the image forming apparatus 1 will be described. First, as the instruction signal is outputted from the main body controller 16, the sheets P are sent, one by one, from the sheet accommodating units 11 and 12. Further, an image is formed on the sheet P by the image forming unit 13, and then the sheet P, on which the image is formed, is discharged from the discharge rollers 15.

<Post-Processing Apparatus 2>

The post-processing apparatus 2 has a transport unit 21 which is connected to the image forming apparatus 1, and a finisher unit 22 which performs predetermined processing on the sheet P transported by the transport unit 21.

The transport unit 21 has multiple transport rollers 24 which transport the sheet P, on which the image is formed by the image forming apparatus 1, to the finisher unit 22, and a punching functional unit 25 which punches two holes or four holes through the sheet P.

The finisher unit 22 has a binding processing device 30 which performs binding processing on a bundle B of sheets, transport rollers 31 which transport the sheet P to the binding processing device 30, discharge rollers 35 which discharge the bundle B of sheets bound by the binding processing device 30, a loading unit 36 which loads the discharged bundle B of sheets, and a sheet processing controller 37 which controls operations of the constituent members provided in the post-processing apparatus 2.

Here, an operation of the post-processing apparatus 2 will be described. First, as the instruction signal, which is intended to instruct the sheet processing controller 37 to process the sheet P, is outputted to the sheet processing controller 37 from the main body controller 16, the sheet processing controller 37 outputs an instruction signal that instructs the respective constituent members of the post-processing apparatus 2 to process the sheet P.

The sheet P, on which the image is formed by the image forming apparatus 1, is supplied to the transport unit 21 of the post-processing apparatus 2. The sheet P, which is punched by the punching functional unit 25, is transported to the finisher unit 22 by the transport rollers 24 in the transport unit 21.

The sheet P supplied to the finisher unit 22 is transported by the transport rollers 31, and then the binding processing is performed by the binding processing device 30. Further, the bundle B of sheets, on which the binding processing is performed by the binding processing device 30, is discharged to the loading unit 36 by the discharge rollers 35.

<Sheet Binding Processing Device 30>

Figure 2:
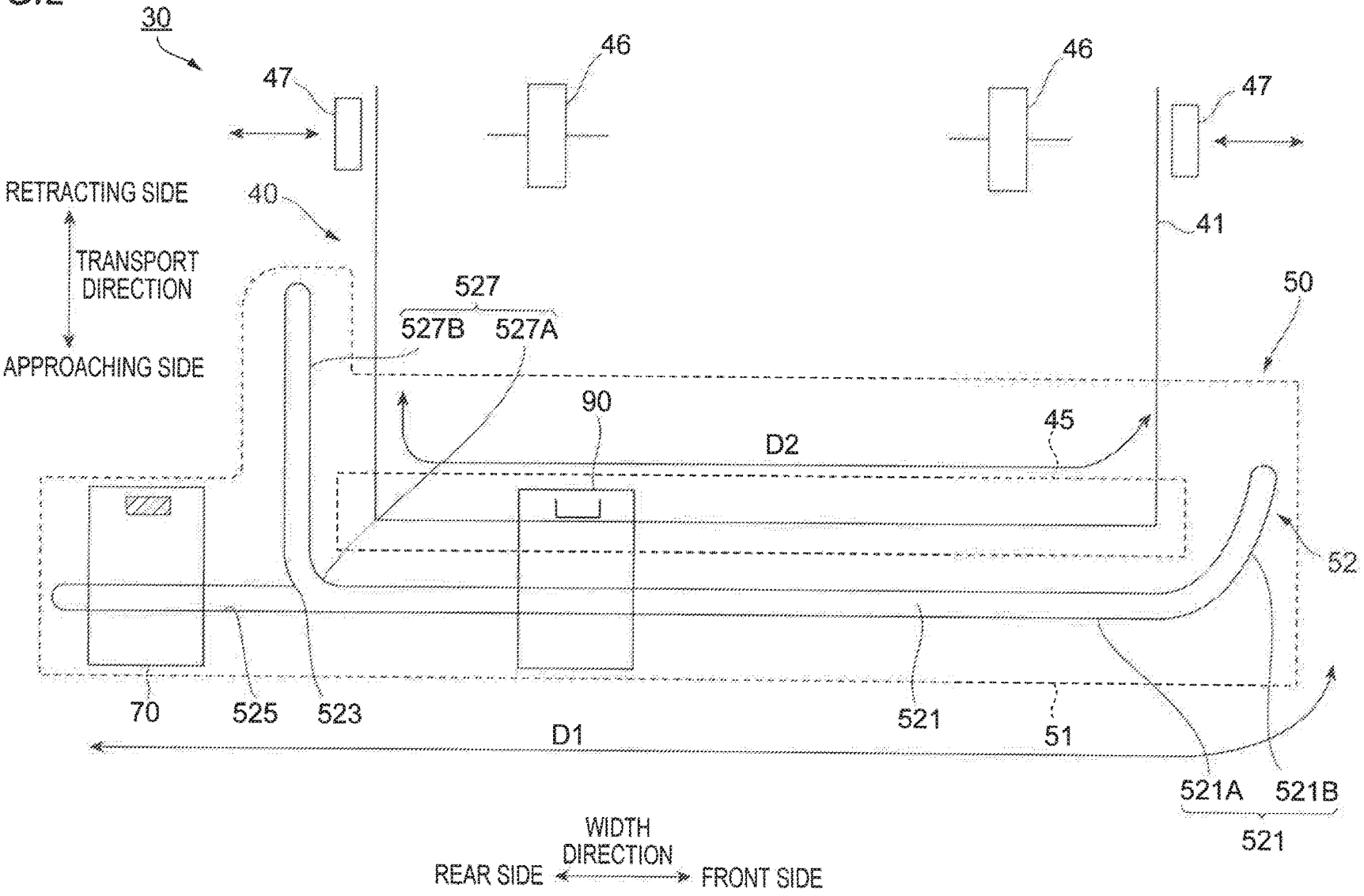
FIG. 2 is a view of a binding processing device when viewed along arrow II in FIG. 1.

FIG. 2 is a view of the binding processing device 30 when viewed along arrow II in FIG. 1.

Next, the sheet binding processing device 30 will be described with reference to FIGS. 1 and 2. The sheet binding processing device 30 forms the bundle B of sheets by stacking the sheets P and performs the binding processing on the bundle B of sheets. The details thereof will be described below, but in the illustrated example, during printing job, the sheet binding processing device 30 may select needleless type binding processing which performs the binding processing on the bundle B of sheets without using staples (needles) or needle type binding processing which performs the binding processing on the bundle B of sheets by using the staples, and the sheet binding processing device 30 may also select positions of the bundle B of sheets at which the binding processing is performed.

The illustrated sheet binding processing device 30 has a sheet stacking unit 40 which forms the bundle B of sheets by stacking the sheets P, a needleless type binding unit 70 which performs the needleless type binding processing, a needle type binding unit 90 which performs the needle type binding processing, and a binding guide unit 50 which guides the needleless type binding unit 70 and the needle type binding unit 90.

<Sheet Stacking Unit 40>

Next, the sheet stacking unit 40 will be described with reference to FIGS. 1 and 2.

The sheet stacking unit 40 has a stacking plate 41 which supports the sheets P from a vertical direction lower side and forms the bundle B of sheets by stacking a necessary number of sheets P, an abutting portion 45 against which tops of the sheets P, which approach the stacking plate 41, hit, transport paddles 46 which transport the sheets P to the abutting portion 45, and width direction alignment units 47 which align width direction positions of the sheets P stacked on the stacking plate 41.

Here, as illustrated in FIG. 1, the stacking plate 41 is provided to be inclined with respect to the horizontal direction. In the illustrated example, a surface on which the sheets P are stacked is provided to be inclined at 30 degrees with respect to the horizontal direction. Since the stacking plate 41 is provided to be inclined as described above, the sheet P is dropped by its own weight along the stacking plate 41. Further, the tops of the sheets P hit against the abutting portion 45, such that the tops of the sheets P are aligned. Further, the bundle B of sheets, which have been stacked on the stacking plate 41 and subjected to the binding processing, is discharged by the discharge rollers 35 in a direction away from the abutting portion 45 (in a direction in which the bundle B of sheets is moved upward along the stacking plate 41).

In the following description, a direction in which the sheet P is transported while being dropped or moved upward along the stacking plate 41, is sometimes simply referred to as a "transport direction". In addition, a direction toward a lower side in the transport direction, that is, a direction in which the sheets P approach the abutting portion 45 is sometimes referred to as an "approaching side". In addition, a direction toward an upper side in the transport direction, that is, a direction in which the sheets P (bundle B of sheets) are discharged in a direction in which the sheets P (bundle B of sheets) are retracted (spaced apart) from the abutting portion 45 is sometimes referred to as a "retracting side".

The abutting portion 45 is provided at a position at which the tops of the sheets P hit against the abutting portion 45, at the transport direction approaching side with respect to the stacking plate 41. In addition, the tops of the sheets P, which hit against the abutting portion 45, are aligned in the width direction. Here, in the following description, the top of the sheet P, which is transported to the transport direction approaching side, is sometimes simply referred to as the "top of the sheet P".

The transport paddles 46 are provided at the upper side of the stacking plate 41 in the vertical direction. The transport paddles 46 are rotated by being driven by a non-illustrated driving source, thereby transporting the sheet P toward the abutting portion 45 (the transport direction approaching side).

The width direction alignment units 47 are provided at both sides in the width direction with the stacking plate 41 interposed between the width direction alignment units 47. The width direction alignment units 47 are moved in the width direction by being driven by a non-illustrated driving source, thereby aligning the positions of the sheet P in the width direction.

<Binding Guide Unit 50>

Figure 3:
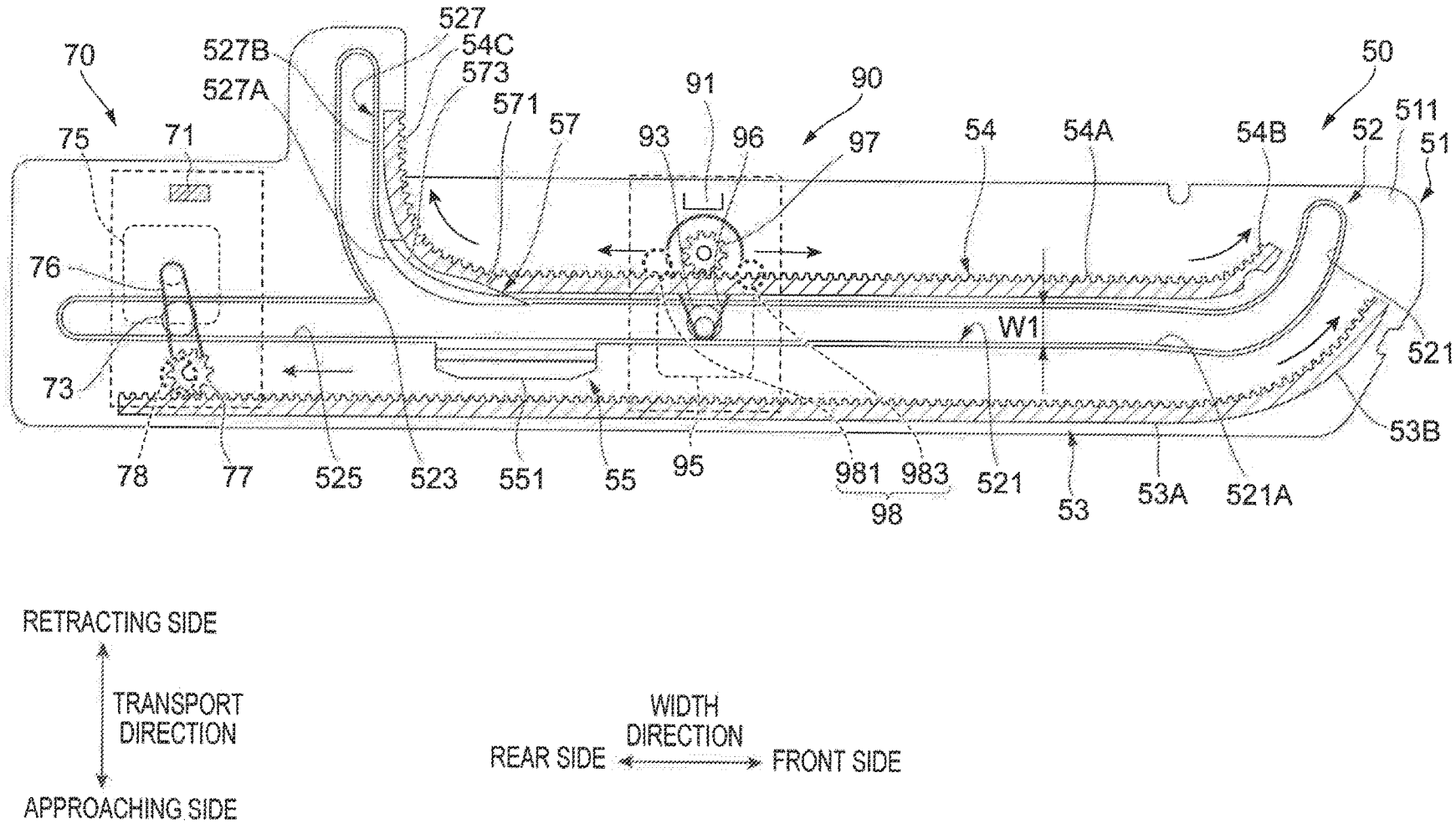
FIG. 3 is a view for explaining a binding guide unit.

FIG. 3 is a view for explaining the binding guide unit 50.

Next, the binding guide unit 50 will be described with reference to FIGS. 1 to 3.

The binding guide unit 50 illustrated in FIG. 3 has a support plate 51 which supports the needleless type binding unit 70 and the needle type binding unit 90, a guide groove 52 which functions as a rail guiding the needleless type binding unit 70 and the needle type binding unit 90 in a predetermined direction, a needleless type rack 53 which is a rack gear provided along a movement path of the needleless type binding unit 70, a needle type rack 54 which is a rack gear provided along a movement path of the needle type binding unit 90, a needleless type guide body 55 which controls a posture of the needleless type binding unit 70, and a needle type guide body 57 which controls a posture of the needle type binding unit 90.

The support plate 51 is a plate-shaped member and has an upper surface 511 which is directed upward in the vertical direction, and a lower surface 513 which is directed downward in the vertical direction (see FIG. 4A to be described below). The support plate 51 is positioned at the transport direction approaching side with respect to the stacking plate 41, and the support plate 51 is provided along the stacking plate 41. That is, similar to the stacking plate 41, the support plate 51 is provided to be inclined with respect to the horizontal direction. In the illustrated example, the upper surface 511 of the support plate 51 is provided to be inclined at 30 degrees with respect to the horizontal direction. In addition, as the support plate 51 is provided to be inclined, the needleless type binding unit 70 and the needle type binding unit 90, which are supported by the support plate 51, are also inclined. That is, the needleless type binding unit 70 and the needle type binding unit 90 are inclined in accordance with the stacking plate 41 (support plate 51). Further, the illustrated support plate 51 has an approximately rectangular shape when viewed from the front side, and the support plate 51 is disposed such that the longitudinal direction of the plate surfaces (the upper surface 511 and the lower surface 513) lies along the width direction.

As illustrated in FIG. 2, the guide groove 52 is an oblong hole (concave portion) provided in the upper surface 511 of the support plate 51. The guide groove 52 in the illustrated example is formed as a through hole that penetrates the support plate 51 in a thickness direction. The guide groove 52 has a common groove 521 which extends in the width direction, a branching-off point 523 which is positioned at a width direction rear side of the common groove 521, and a needleless type groove 525 and a needle type groove 527 which be continuous with the common groove 521 through the branching-off point 523. Further, the common groove 521, the needleless type groove 525, and the needle type groove 527 are formed to have a common groove width W1 (see FIG. 3).

Here, as illustrated in FIG. 2, the needleless type binding unit 70 may be moved between the common groove 521 and the needleless type groove 525 through the branching-off point 523 (see arrow D1 in the drawing). In addition, the needle type binding unit 90 may be moved between the common groove 521 and the needle type groove 527 through the branching-off point 523 (see arrow D2 in the drawing). The needleless type binding unit 70 and the needle type binding unit 90 may be guided to predetermined retracted positions by switching the movement paths. More specifically, the needle type binding unit 90 retracts to the needle type groove 527 when the needleless type binding unit 70 performs the binding processing. In addition, the needleless type binding unit 70 retracts to the needleless type groove 525 when the needle type binding unit 90 performs the binding processing. In this way, the binding processing operation of any one of the needleless type binding unit 70 and the needle type binding unit 90 is inhibited from being hindered by the binding processing operation of the other of the needleless type binding unit 70 and the needle type binding unit 90.

The common groove 521 extends in the width direction as described above, and a width direction front side of the common groove 521 is curved toward the transport direction retracting side. More specifically, the common groove 521 has a width direction straight portion 521A which is provided in the width direction, and a front curved portion 521B which extends to the transport direction retracting side from a width direction front side of the width direction straight portion 521A. Further, both of the needleless type binding unit 70 and the needle type binding unit 90 pass through the common groove 521.

The needleless type groove 525 extends approximately rectilinearly in the width direction. More specifically, the needleless type groove 525 is continuous with the width direction straight portion 521A of the common groove 521 through the branching-off point 523, and the needleless type groove 525 is provided in a direction (width direction) that coincides with the width direction straight portion 521A of the common groove 521. Further, while the needleless type binding unit 70 passes through the needleless type groove 525, the needle type binding unit 90 does not pass through the needleless type groove 525.

The needle type groove 527 is continuous with the common groove 521 through the branching-off point 523, and the needle type groove 527 is curved from the branching-off point 523 and then extends to the transport direction retracting side. More specifically, the needle type groove 527 has a rear curved portion 527A which extends to the transport direction retracting side from a width direction rear side of the width direction straight portion 521A of the common groove 521, and a transport direction straight portion 527B which extends in the transport direction from the rear curved portion 527A. Additionally, the transport direction straight portion 527B is a portion that extends upward in the vertical direction when viewed from the branching-off point 523. Further, while the needle type binding unit 90 passes through the needle type groove 527, the needleless type binding unit 70 does not pass through the needle type groove 527. In addition, the rear curved portion 527A of the needle type groove 527 has a larger curvature (a smaller radius of curvature) than the front curved portion 521B of the common groove 521.

Meanwhile, in the illustrated example, when comparing a weight of the needleless type binding unit 70 and a weight of the needle type binding unit 90, the needleless type binding unit 70 is heavier in weight and the needle type binding unit 90 is lighter in weight in consideration of differences in weights and numbers of the constituent members. Therefore, the needleless type binding unit 70 requires greater driving power at the time of changing directions of (at the time of rotating) the needleless type binding unit 70 and the needle type binding unit 90. Therefore, in the illustrated example, driving power for moving the needleless type binding unit 70 is inhibited by inhibiting the amount of change in direction (rotation angle) of the needleless type binding unit 70 having a heavier weight. Specifically, the movement path of the needleless type binding unit 70 is defined by the needleless type groove 525 between the needleless type groove 525 and the needle type groove 527. That is, the needleless type groove 525, which rectilinearly continues from the width direction straight portion 521A of the common groove 521 is defined as the movement path of the needleless type binding unit 70. Meanwhile, the direction of the needle type binding unit 90, which is lighter in weight, is more easily changed than the direction of the needleless type binding unit 70, such that the needle type groove 527 is defined as a path of the needle type binding unit 90. That is, the needle type groove 527, which is curved and extends from the width direction straight portion 521A of the common groove 521 is defined as the movement path of the needle type binding unit 90.

Here, in the illustrated example, since the needleless type groove 525 is provided in the width direction, a change in position in the transport direction, that is, a displacement magnitude in the vertical direction is relatively small when the needleless type binding unit 70 moves along the needleless type groove 525. Meanwhile, since the needle type groove 527 has a portion that extends in the transport direction, a displacement magnitude in the transport direction, that is, a displacement magnitude in the vertical direction is relatively large when the needle type binding unit 90 moves along the needle type groove 527. Further, greater driving power is required as the displacement magnitude in the vertical direction is increased. Therefore, in the illustrated example, the needleless type binding unit 70 is configured to pass through the needleless type groove 525 so that the displacement magnitude of the needleless type binding unit 70, which is heavier in weight, is small in the vertical direction. In addition, the needle type binding unit 90, which is lighter in weight, is configured to pass through the needle type groove 527.

Next, the needleless type rack 53 and the needle type rack 54 will be described. First, the needleless type rack 53 is provided along the common groove 521 and the needleless type groove 525. More specifically, the illustrated needleless type rack 53 has a needleless type rack straight portion 53A which has a longitudinal direction extending in the width direction and has an approximately straight shape, and a needleless type rack curved portion 53B which is curved and extends along the front curved portion 521B from a width direction front end of the needleless type rack straight portion 53A. The needleless type rack 53 is provided to be closer to the transport direction approaching side than the common groove 521 and the needleless type groove 525 are to the transport direction approaching side. Further, in the illustrated example, the needleless type rack 53 is provided on the lower surface 513 (see FIG. 4A to be described below) of the support plate 51, that is, at a rear side of the support plate 51. In addition, a tooth surface of the needleless type rack 53 is provided on a surface of the needleless type rack 53 which is directed toward the transport direction retracting side (upward in the vertical direction).

The needle type rack 54 is provided along the common groove 521 and the needle type groove 527. More specifically, the illustrated needle type rack 54 has a needle type rack straight portion 54A which has a longitudinal direction extending in the width direction and has an approximately straight shape, a needle type rack front curved portion 54B which is curved and extends along the front curved portion 521B from a width direction front end of the needle type rack straight portion 54A, and a needle type rack rear curved portion 54C which is curved and extends along the rear curved portion 527A from a width direction rear end of the needle type rack straight portion 54A. In addition, the needle type rack 54 is provided to be closer to the transport direction retracting side than the common groove 521 is to the transport direction retracting side. In addition, the needle type rack 54 is provided to be closer to the width direction front side than the needle type groove 527 is to the width direction front side. In addition, in the illustrated example, the needle type rack 54 is provided on the lower surface 513 (see FIG. 4A to be described below) of the support plate 51, that is, at the rear side of the support plate 51. In addition, a tooth surface of the needle type rack 54 is provided on a surface of the needle type rack 54 which is directed toward the transport direction retracting side (upward in the vertical direction).

Here, the guide groove 52, the needleless type rack 53, and the needle type rack 54 extend to the width direction front side of the support plate 51. In this way, the needleless type binding unit 70 and the needle type binding unit 90, which move along the guide groove 52, may approach a user positioned at the front side of the image forming apparatus 1 (see FIG. 1). In other words, the user may perform an operation on (may access) the needleless type binding unit 70 and the needle type binding unit 90 from the front side of the image forming apparatus 1 (see FIG. 1). Therefore, the user easily performs an operation on the needle type binding unit 90, for example, such as an operation of supplementing staple needles. Similarly, the user easily performs an operation on the needleless type binding unit 70, such as maintenance and inspection of the needleless type binding unit 70.

The needleless type rack 53 and the needle type rack 54 are provided outside the common groove 521, the needleless type groove 525, and the needle type groove 527. Further, the needleless type rack 53 and the needle type rack 54 are provided at positions that face each other with the common groove 521 interposed therebetween. More specifically, in the illustrated example, the needleless type rack 53 and the needle type rack 54 are provided with the common groove 521, the needleless type groove 525, and the needle type groove 527 interposed therebetween.

As described above, the tooth surface of the needleless type rack 53 is provided to be directed upward in the vertical direction. The tooth surface, which is directed upward, meshes with a needleless type pinion gear 77 (to be described below) of the needleless type binding unit 70. That is, the tooth surface of the needleless type rack 53 is disposed to support a part of a load of the needleless type binding unit 70. Accordingly, the needleless type rack 53 and the needleless type pinion gear 77 can be prevented from being spaced apart from each other.

Similarly, as described above, the tooth surface of the needle type rack 54, which is directed upward, meshes with a needle type pinion gear 97 (to be described below) of the needle type binding unit 90. Accordingly, the tooth surface of the needle type rack 54 is disposed to support a part of a load of the needle type binding unit 90, such that the needle type rack 54 and the needle type pinion gear 97 can be prevented from being spaced apart from each other.

<Needleless Type Guide Body 55 and Needle Type Guide Body 57>

Figure 4A:
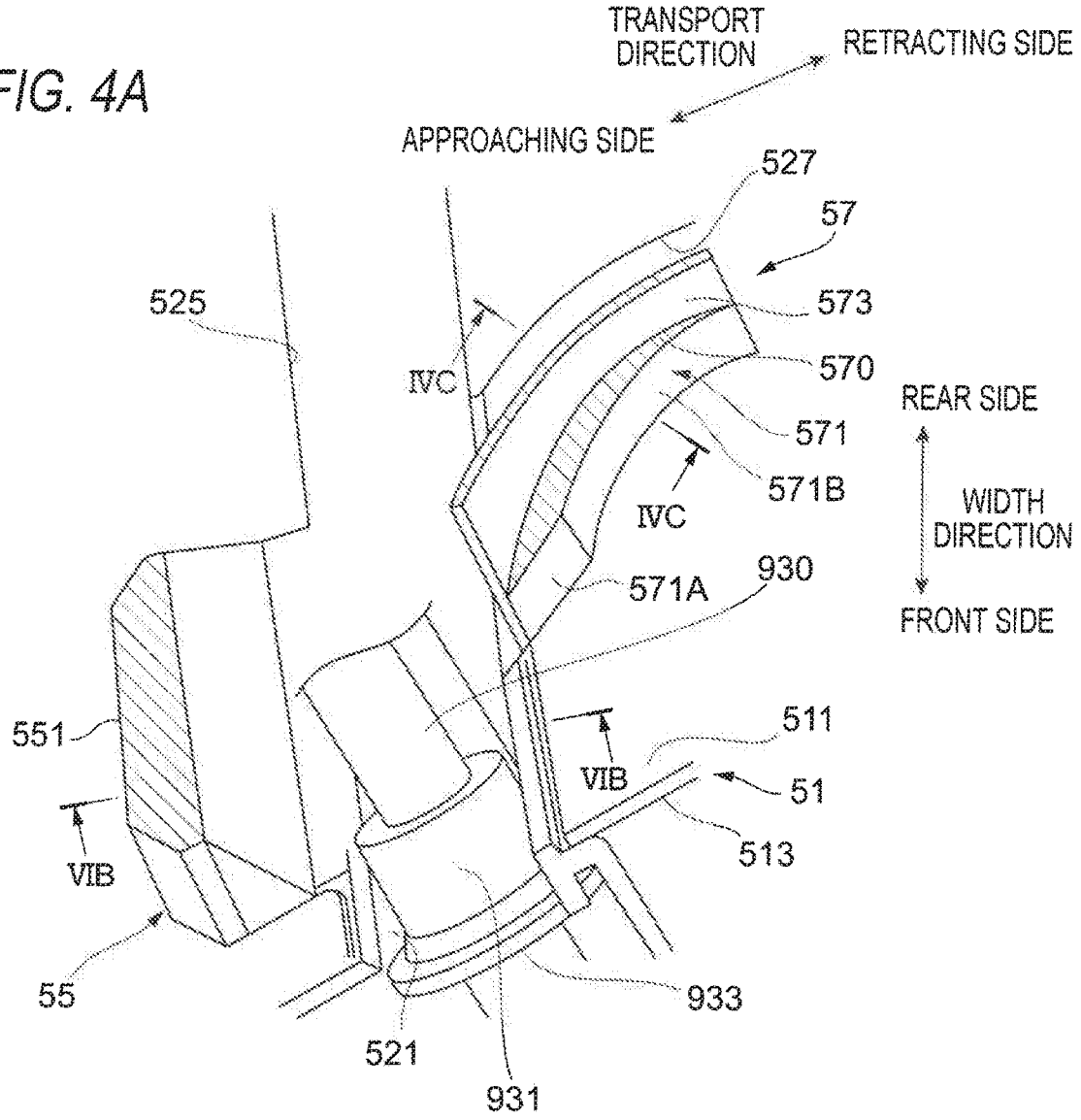
FIGS. 4A to 4C are views for explaining a needleless type guide body and a needle type guide body.
Figure 4B:
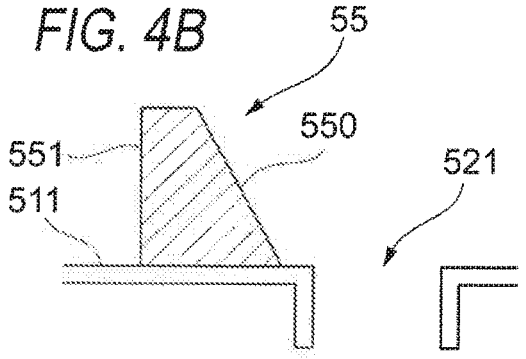
Figure 4C:
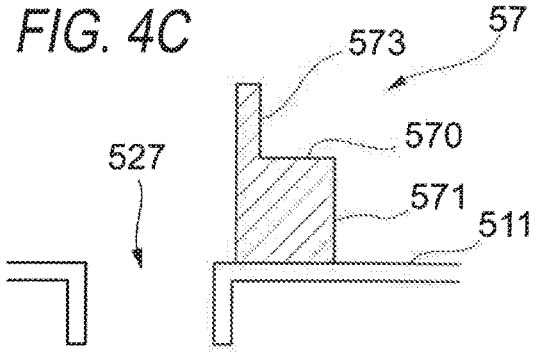

FIGS. 4A to 4C are views for explaining the needleless type guide body 55 and the needle type guide body 57. Specifically, FIG. 4A is a perspective view of the needleless type guide body 55 and the needle type guide body 57, FIG. 4B is a cross-sectional view of the needleless type guide body 55 taken along line IVB-IVB in FIG. 4A, and FIG. 4C is a cross-sectional view of the needle type guide body 57 taken along line IVC-IVC in FIG. 4A.

Next, the needleless type guide body 55 and the needle type guide body 57 will be described with reference to FIG. 3 and FIGS. 4A to 4C. Here, the needleless type guide body 55 will be described first, and then the needle type guide body 57 will be described.

First, the needleless type guide body 55 will be described. As illustrated in FIG. 3 and FIGS. 4A to 4C, the needleless type guide body 55 has an approximately rectangular parallelepiped shape and has a longitudinal direction provided along the common groove 521 (in the width direction). The needleless type guide body 55 is provided in a region through which the needleless type binding unit 70 passes. Specifically, the needleless type guide body 55 is provided on the upper surface 511 of the support plate 51 and provided to be closer to the transport direction approaching side (vertical direction lower side) than the common groove 521 (needleless type groove 525) is to the transport direction approaching side. In addition, the needleless type guide body 55 is provided to be closer to the width direction front side than the branching-off point 523 is to the width direction front side. That is, the needleless type guide body 55 is provided upstream of the branching-off point 523 with respect to the movement direction of the needleless type binding unit 70 that moves from the common groove 521 toward the needleless type groove 525.

Here, as illustrated in FIG. 4B, the illustrated needleless type guide body 55 has an inclined surface 550 which is formed at a side of the common groove 521, and a first flat surface 551 which is formed at a side opposite to the common groove 521. Here, the inclined surface 550 is a side surface that rises from the support plate 51, and the inclined surface 550 is inclined in a direction in which the inclined surface 550 is spaced apart from the common groove 521 as portions of the inclined surface 550 are spaced apart from the support plate 51. In addition, the first flat surface 551 is a side surface that rises from the support plate 51, and the first flat surface 551 extends in a direction intersecting (orthogonal to) the support plate 51. Additionally, the first flat surface 551 is a surface that lies along the common groove 521, that is, a surface directed toward the transport direction approaching side (vertical direction lower side). Although the details will be described below, the first flat surface 551 of the needleless type guide body 55 engages with a needleless type guide pin 78 (to be described below) provided on the needleless type binding unit 70, thereby controlling the direction of the needleless type binding unit 70. Further, the needleless type guide body 55 may be perceived as a guide that is provided at the branching-off point 523 and makes a pair with the needleless type guide pin 78.

Next, the needle type guide body 57 will be described. As illustrated in FIG. 3 and FIGS. 4A to 4C, the needle type guide body 57 is an arc-shaped member provided along the needle type groove 527. The needle type guide body 57 is provided in a region through which the needle type binding unit 90 passes. Specifically, the needle type guide body 57 is provided on the upper surface 511 of the support plate 51 and provided to be closer to the transport direction retracting side (vertical direction upper side) than the common groove 521 is to the transport direction retracting side. In addition, the needle type guide body 57 is provided to be closer to the width direction front side than the needle type groove 527 and the branching-off point 523 are to the width direction front side. That is, the needle type guide body 57 is provided upstream of the branching-off point 523 with respect to the movement direction of the needle type binding unit 90 that moves from the common groove 521 to the needle type groove 527. More specifically, the needle type guide body 57 is provided at a position that faces the branching-off point 523 with the needle type groove 527 interposed between the needle type guide body 57 and the branching-off point 523, that is, the needle type guide body 57 is provided inside the needle type groove 527, that is, at a side inward in a radial direction of a curved surface of the rear curved portion 527A of the needle type groove 527. Further, in the illustrated example, the needleless type guide body 55 and the needle type guide body 57 are provided at the positions that face each other with the common groove 521 interposed therebetween, such that the region through which the needleless type guide pin 78 passes and the region through which needle type guide pins 98 pass may be separated from each other. Accordingly, the movement paths are assuredly switched by using the needleless type guide body 55, the needle type guide body 57, the needleless type guide pin 78, and the needle type guide pins 98.

Here, as illustrated in FIG. 4C, the needle type guide body 57 has a cut-out 570 formed at a side opposite to the needle type groove 527, such that a stepped portion is formed. That is, the needle type guide body 57 is formed in a step-like manner. The needle type guide body 57 has a first curved surface 571 and a second curved surface 573 which are surfaces that extend in a direction rising from the support plate 51 at the side opposite to the needle type groove 527, that is, surfaces curved along the needle type groove 527. Additionally, both of the first curved surface 571 and the second curved surface 573 are continuously provided on the needle type guide body 57.

Here, the first curved surface 571 is a surface that extends in a direction intersecting (orthogonal to) the support plate 51, and the first curved surface 571 is formed at a position close to the support plate 51. The first curved surface 571 guides a first needle type pin (stud) 981 to be described below. The illustrated first curved surface 571 has a flat portion 571A which is formed at a side of the common groove 521, and a curved portion 571B which is formed and curved to be closer to the needle type groove 527 than the flat portion 571A is to the needle type groove 527. More specifically, the first curved surface 571 is a portion which is provided in a movement path of the first needle type pin 981, such that the first needle type pin 981 hits against (engages with) the first curved surface 571. Meanwhile, the first curved surface 571 is provided outside a movement path of a second needle type pin 983 to be described below, such that the second needle type pin 983 does not hit against the first curved surface 571. That is, the first curved surface 571 and the second needle type pin 983 are provided in a non-contact manner.

The second curved surface 573 is a surface that extends in a direction intersecting (orthogonal to) the support plate 51, and the second curved surface 573 is formed and positioned to be farther from the support plate 51 than the first curved surface 571 is from the support plate 51. The second curved surface 573 guides the second needle type pin (stud) 983 to be described below. In addition, the second curved surface 573 is positioned to be closer to the needle type groove 527 than the first curved surface 571 is to the needle type groove 527. More specifically, the second curved surface 573 is a portion which is provided in the movement path of the second needle type pin 983, such that the second needle type pin 983 hits against (engages with) the second curved surface 573. Meanwhile, the second curved surface 573 is provided outside the movement path of the first needle type pin 981, such that the first needle type pin 981 does not hit against the second curved surface 573. That is, the second curved surface 573 and the first needle type pin 981 are provided in a non-contact manner. Additionally, degrees of freedom of the shapes of the first curved surface 571 and the second curved surface 573 are increased because the first curved surface 571 and the second needle type pin 983 are provided in a non-contact manner and the second curved surface 573 and the first needle type pin 981 are provided in a non-contact manner. That is, in a designing step, trajectories of the first needle type pin 981 and the second needle type pin 983 may be more freely set.

Although the details will be described below, as the needle type binding unit 90 moves, the first curved surface 571 and the second curved surface 573 of the needle type guide body 57 engage with the needle type guide pins 98 (the first needle type pin 981 and the second needle type pin 983) provided on the needle type binding unit 90, thereby controlling the direction of the needle type binding unit 90. Further, the needle type guide body 57 may be perceived as a guide that is provided at the branching-off point 523 and makes a pair with the needle type guide pins 98.

Meanwhile, the first curved surface 571 and the second curved surface 573 are surfaces that lie along the needle type groove 527, that is, surfaces directed toward the transport direction retracting side (vertical direction upper side). In addition, the first curved surface 571 is provided to be closer to a radial direction inner side of the curved surface than the second curved surface 573 is to the radial direction inner side of the curved surface. In addition, in the illustrated example, the first curved surface 571 and the second curved surface 573 have different shapes such as curvatures. Specifically, while the first curved surface 571 has the flat portion 571A, the second curved surface 573 does not have a surface like the flat portion 571A. In addition, the curved portion 571B of the first curved surface 571 has a larger curvature (a smaller radius of curvature) than the second curved surface 573.

The needleless type guide body 55 and the needle type guide body 57 are provided at positions that face each other with the common groove 521 interposed between the needleless type guide body 55 and the needle type guide body 57. In addition, the needleless type guide body 55 and the needle type guide body 57 are provided at positions that faces the branching-off point 523. In addition, the needleless type guide body 55 is provided at a position which is different in the width direction from a position of the needle type guide body 57. In the illustrated example, the needleless type guide body 55 is provided to be closer to the width direction front side than the needle type guide body 57 is to the width direction front side. Further, the positions of the needleless type guide body 55 and the needle type guide body 57 are fixed, and the positions of the needleless type guide body 55 and the needle type guide body 57 are not changed relative to the branching-off point 523.

<Needle Type Binding Unit 90>

Figure 5:
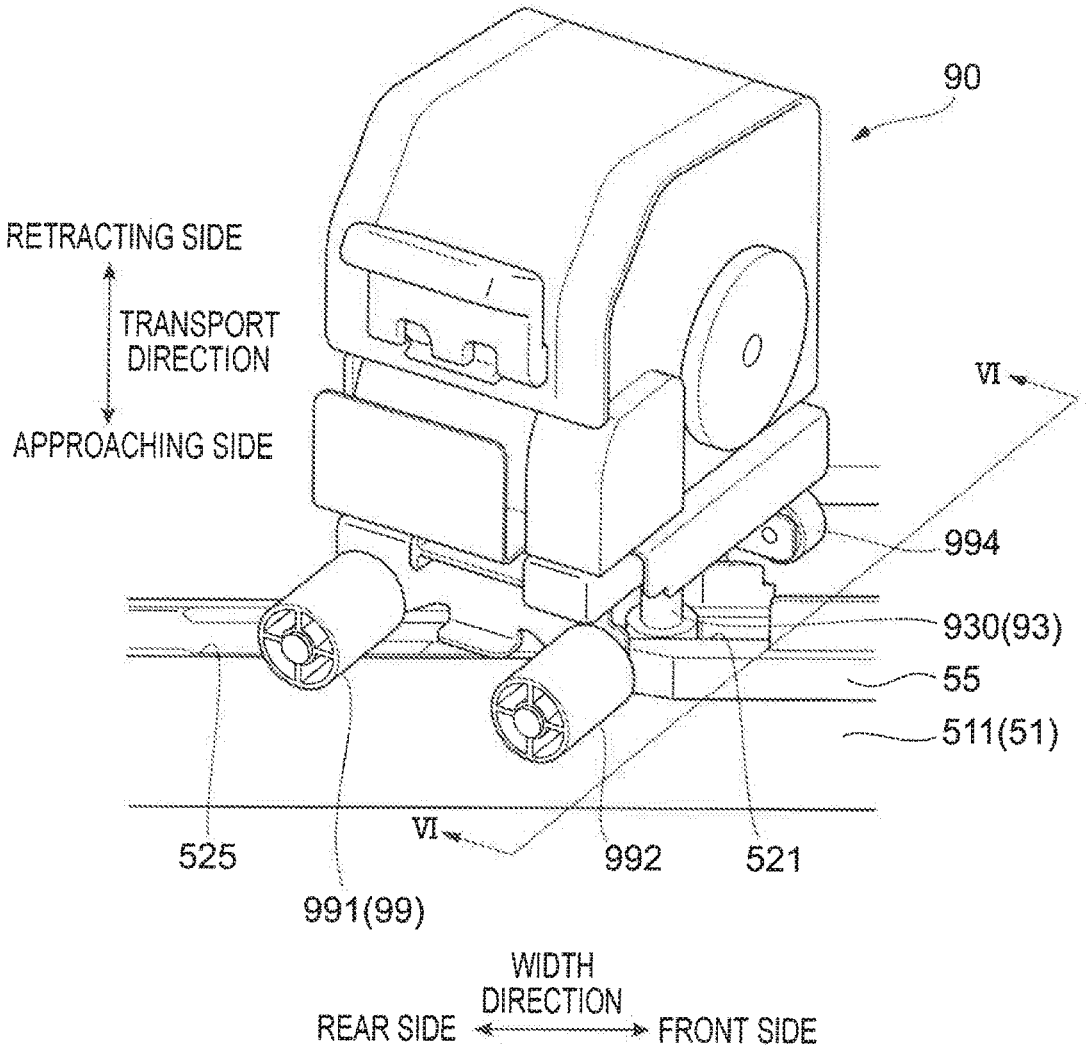
FIG. 5 is a perspective view of a needle type binding unit.

FIG. 5 is a perspective view of the needle type binding unit 90.

Figure 6:
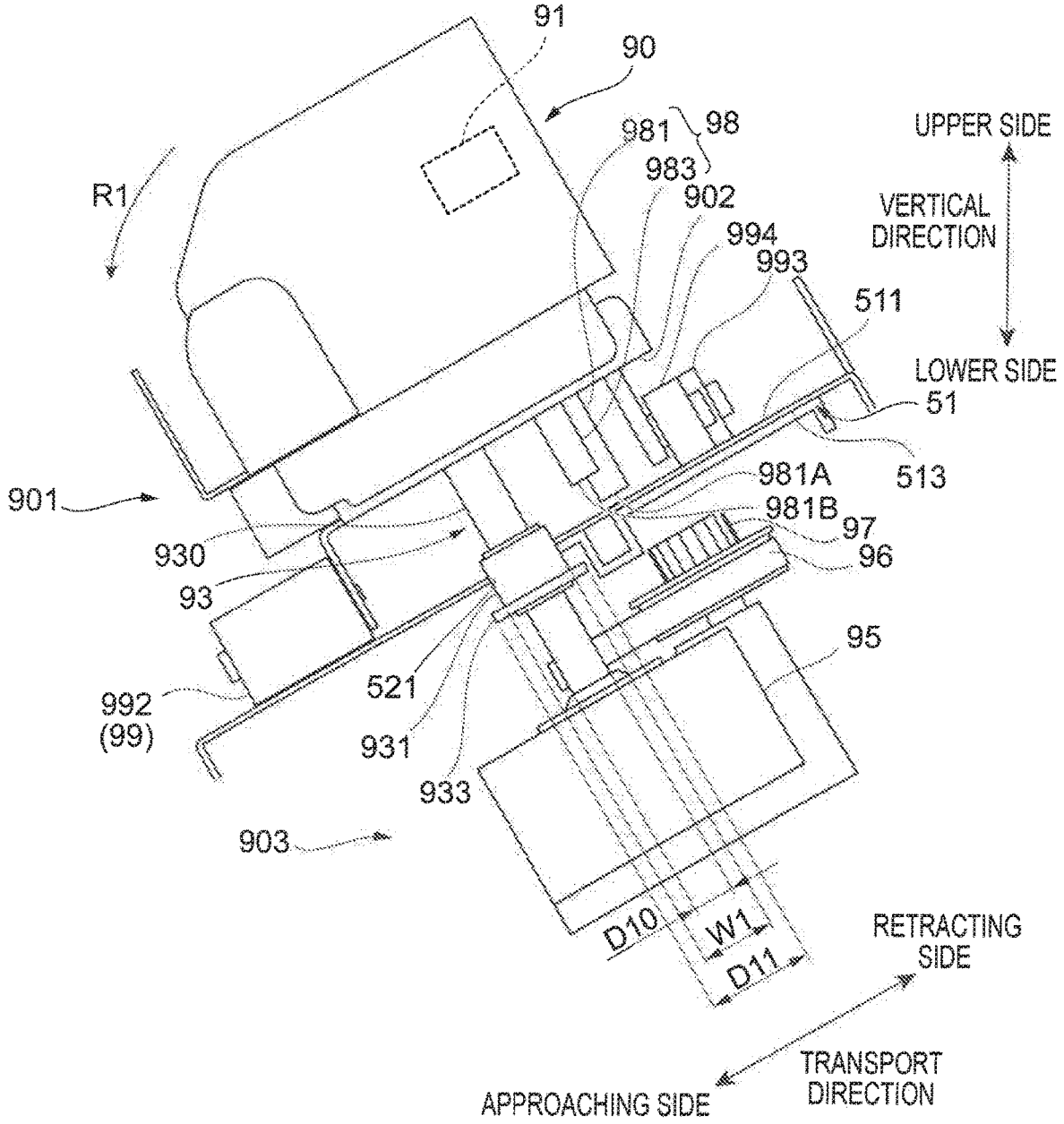
FIG. 6 is a cross-sectional view of the needle type binding unit taken along line VI-VI in FIG. 5.

FIG. 6 is a cross-sectional view of the needle type binding unit 90 taken along line VI-VI in FIG. 5.

Figure 7:
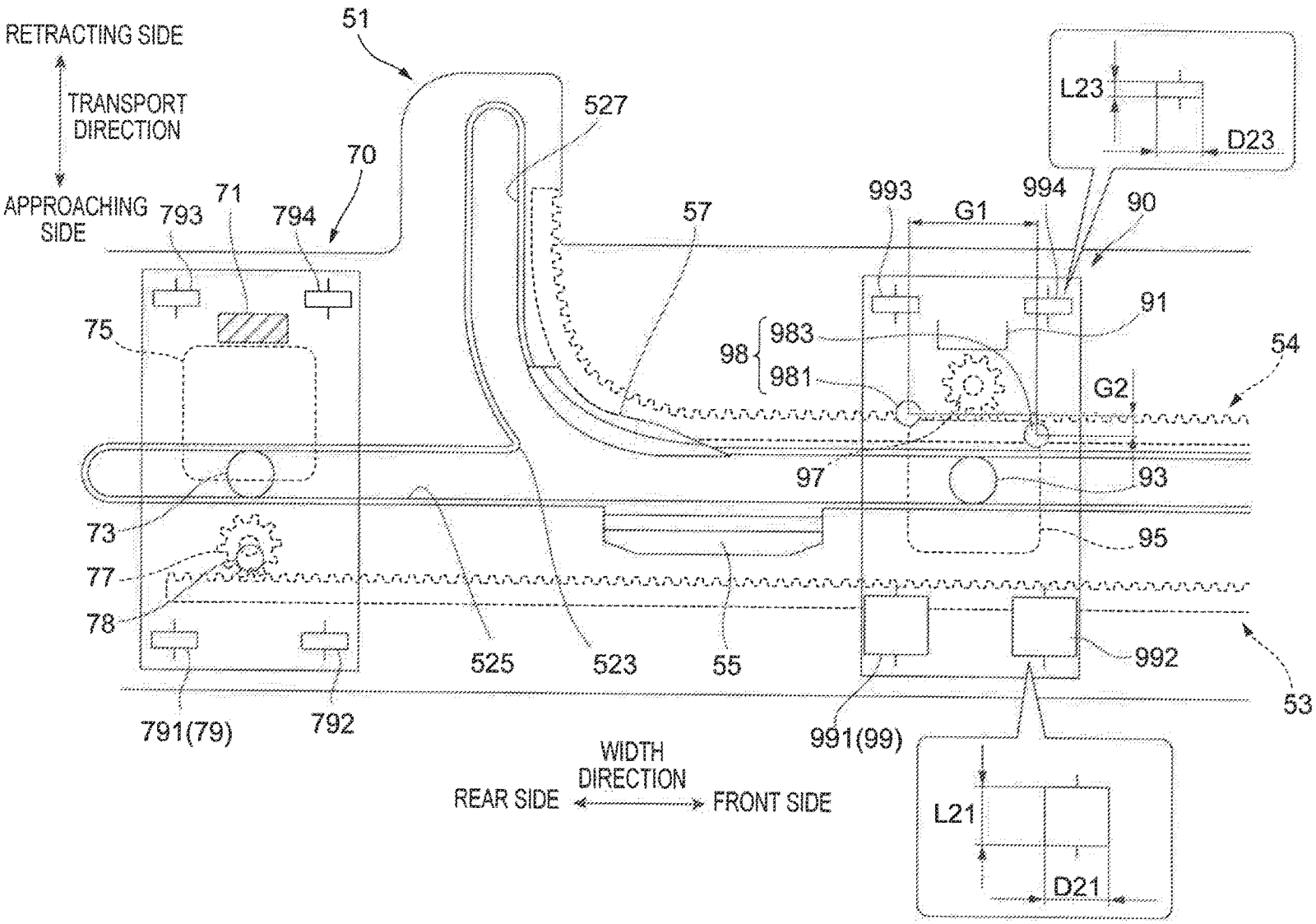
FIG. 7 is a view for explaining the needle type binding unit and a needleless type binding unit.

FIG. 7 is a view for explaining the needle type binding unit 90 and the needleless type binding unit 70.

Next, the needle type binding unit 90 will be described below with reference to FIGS. 5 to 7.

As illustrated in FIGS. 5 to 7, the needle type binding unit 90 has a needle type binding piece (member) 91 which allows the staple (needle) to penetrate the sheet P (see FIG. 1), a needle type moving roller 93 which is provided to be movable in the guide groove 52, a needle type motor 95 which is a driving source, a timing belt 96 (see FIG. 6) which is rotated by being driven by the needle type motor 95, the needle type pinion gear 97 which is rotated by being driven by the needle type motor 95 through the timing belt 96, the needle type guide pins 98 which are guided by the needle type guide body 57, and needle type wheels 99 which move while rotating on the upper surface (surface) 511 of the support plate 51. Further, since the needle type binding unit 90 has the needle type motor 95 as described above, the needle type binding unit 90 may be perceived as having a configuration in which the needle type binding unit 90 is integrated with the driving source for allowing the needle type binding unit 90 to travel.

Here, as illustrated in FIG. 6, the needle type binding unit 90 has an upper unit 901 which is positioned on the upper surface 511 of the support plate 51, and a lower unit 903 which is positioned on the lower surface 513 of the support plate 51. In the illustrated example, the upper unit 901 has the needle type binding piece 91 and the needle type wheels 99. In addition, in the illustrated example, the lower unit 903 has the needle type motor 95, the timing belt 96, and the needle type pinion gear 97. Further, the needle type moving roller 93, which is provided to penetrate the support plate 51 (guide groove 52), connects the upper unit 901 and the lower unit 903. More specifically, the needle type binding unit 90 may rotate about the needle type moving roller 93. In other words, the upper unit 901 and the lower unit 903 rotate integrally with the needle type moving roller 93.

Here, the needle type moving roller 93 will be described. As illustrated in FIG. 6, the needle type moving roller 93 has a needle type moving pin 930 which is provided to penetrate the guide groove 52, a needle type roller body 931 which is provided at an outer circumference of the needle type moving pin 930, and a needle type flange 933 which is a flange-shaped member provided at an outer circumference of the needle type roller body 931. More specifically, an outer diameter D10 of the needle type moving pin 930 of the needle type moving roller 93 is smaller than a groove width W1 of the guide groove 52 (outer diameter D10<groove width W1). In addition, an outer diameter D11 of the needle type flange 933 of the needle type moving roller 93 is larger than the groove width W1 of the guide groove 52 (groove width W1<outer diameter D11). The needle type flange 933 is provided at a side of the lower surface 513 of the support plate 51. Further, the needle type flange 933 restricts the needle type moving roller 93 from tilting with respect to the support plate 51, and in other words, the needle type flange 933 restricts the needle type binding unit 90 from tilting with respect to the support plate 51. Accordingly, for example, the needle type binding unit 90 is restricted from tilting, so that driving power for moving the needle type binding unit 90 is prevented from increasing.

Next, the needle type guide pins 98 will be described. As illustrated in FIG. 6, the needle type guide pins 98 are provided as parts of the upper unit 901. More specifically, each of the needle type guide pins 98 is provided in the form of a projection that protrudes toward the upper surface 511 from a frame body 902 which is provided on a portion of the upper unit 901 which faces the upper surface 511. The needle type guide pins 98 include the first needle type pin 981 and the second needle type pin 983. Here, each of the first needle type pin 981 and the second needle type pin 983 has an approximately columnar shape. In addition, the first needle type pin 981 has a larger axial length than the second needle type pin 983, such that the first needle type pin 981 further protrudes toward the upper surface 511. In other words, a distance between a top 981A of the first needle type pin 981 and the upper surface 511 is smaller than a distance between a top 983A of the second needle type pin 983 and the upper surface 511.

Meanwhile, as illustrated in FIG. 7, the first needle type pin 981 and the second needle type pin 983 are positioned at different positions on the needle type binding unit 90 (upper unit 901). Specifically, width direction positions of the first needle type pin 981 and the second needle type pin 983 are different from each other on the needle type binding unit 90 disposed in the common groove 521 (see distance G1 in the drawing). More specifically, the first needle type pin 981 is provided at the width direction rear side, and the second needle type pin 983 is provided at the width direction front side. In addition, transport direction positions of the first needle type pin 981 and the second needle type pin 983 are different from each other on the needle type binding unit 90 disposed in the common groove 521 (see distance G2 in the drawing). More specifically, the first needle type pin 981 is provided at the transport direction retracting side, and the second needle type pin 983 is provided at the transport direction approaching side.

Next, the needle type wheels 99 will be described. As illustrated in FIG. 7, the needle type wheels 99 include a first needle type wheel 991, a second needle type wheel 992, a third needle type wheel 993, and a fourth needle type wheel 994, each of which is an approximately columnar (disk-shaped) member provided to be rotatable. In the needle type binding unit 90 disposed in the common groove 521, a rotational axis of each of the first to fourth needle type wheels 991 to 994 lies in the transport direction. In addition, the first needle type wheel 991 and the second needle type wheel 992 are provided to be closer to the transport direction approaching side than the common groove 521 is to the transport direction approaching side, and the third needle type wheel 993 and the fourth needle type wheel 994 are provided to be closer to the transport direction retracting side than the common groove 521 is to the transport direction retracting side. More specifically, the first needle type wheel 991 is provided to face the third needle type wheel 993 with the common groove 521 interposed between the first needle type wheel 991 and the third needle type wheel 993, and the second needle type wheel 992 is provided to face the fourth needle type wheel 994 with the common groove 521 interposed between the second needle type wheel 992 and the fourth needle type wheel 994.

Next, dimensions of the first to fourth needle type wheels 991 to 994 will be described. First, the first needle type wheel 991 and the second needle type wheel 992 are formed to have an equal dimension. In addition, the third needle type wheel 993 and the fourth needle type wheel 994 have an equal dimension. Therefore, in the following description, a dimensional relationship between the first needle type wheel 991 and the third needle type wheel 993 will be described.

First, an outer diameter D21 of the first needle type wheel 991 is larger than an outer diameter D23 of the third needle type wheel 993 (outer diameter D21>outer diameter D23). In addition, a length L21 in a direction along the axis of the first needle type wheel 991 is longer than a length L23 in a direction along the axis of the third needle type wheel 993 (length L21>length L23). In this way, the first needle type wheel 991 (second needle type wheel 992) is configured to have dimensions larger than those of the third needle type wheel 993 (fourth needle type wheel 994). Thus, an end (wheel end) of the first needle type wheel 991 is restricted from falling into the needleless type groove 525 and causing defective traveling (derailment), as described below, when the first needle type wheel 991 (second needle type wheel 992) moves across the needleless type groove 525.

<Needleless Type Binding Unit 70>

Figure 8:
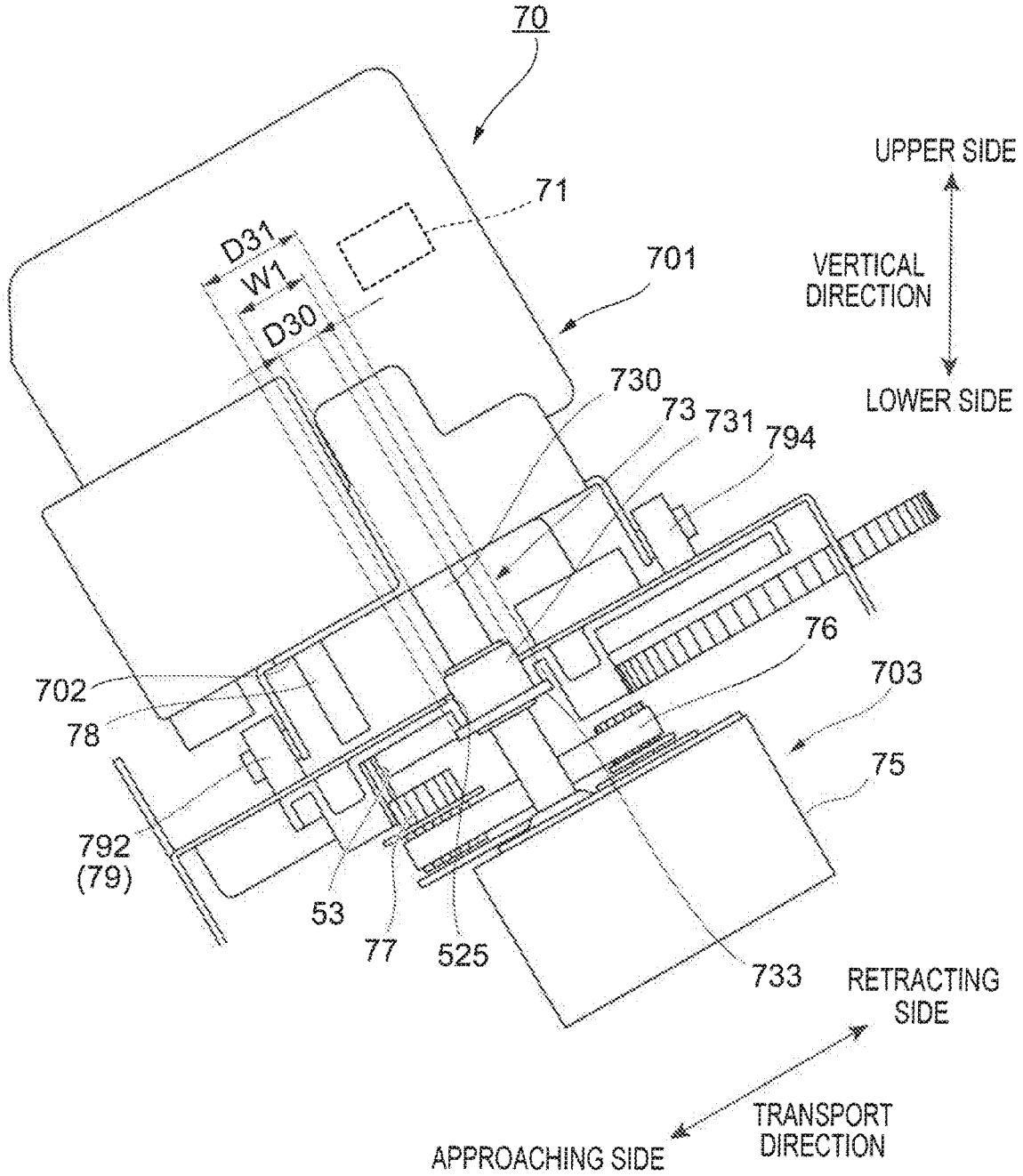
FIG. 8 is a cross-sectional view of the needleless type binding unit.

FIG. 8 is a cross-sectional view of the needleless type binding unit 70.

Next, the needleless type binding unit 70 will be described with reference to FIGS. 7 and 8.

As illustrated in FIG. 7, the needleless type binding unit 70 has a needleless type binding piece (member) 71 which performs the binding processing of joining fibers that constitute the sheet P, a needleless type moving roller 73 which is provided to be movable in the guide groove 52, a needleless type motor 75 which is a driving source, a timing belt 76 which is rotated by being driven by the needleless type motor 75, a needleless type pinion gear 77 which is rotated by being driven by the needleless type motor 75 through the timing belt 76, a needleless type guide pin 78 which is guided by the needle type guide body 57, and needleless type wheels 79 which move while rotating on the upper surface 511 of the support plate 51. Further, since the needleless type binding unit 70 has the needleless type motor 75 as described above, the needleless type binding unit 70 may be perceived as having a configuration in which the needleless type binding unit 70 is integrated with the driving source for moving the needleless type binding unit 70 (allowing the needleless type binding unit 70 to travel).

Here, as illustrated in FIG. 8, the needleless type binding unit 70 has an upper unit 701 which is positioned on the upper surface 511 of the support plate 51, and a lower unit 703 which is positioned on the lower surface 513 of the support plate 51. Further, the upper unit 701 has the needleless type binding piece (member) 71 and the needleless type wheel 79. In addition, in the illustrated example, the lower unit 703 has the needleless type motor 75, the timing belt 76, and the needleless type pinion gear 77. Further, the needleless type moving roller 73, which is provided to penetrate the support plate 51 (guide groove 52), connects the upper unit 701 and the lower unit 703. More specifically, the needleless type binding unit 70 may rotate about the needleless type moving roller 73. In other words, the upper unit 701 and the lower unit 703 rotated integrally with the needleless type moving roller 73.

Here, the needleless type moving roller 73 will be described. As illustrated in FIG. 8, the needleless type moving roller 73 has a needleless type moving pin 730 which is provided to penetrate the guide groove 52, a needleless type roller body 731 which is provided at an outer circumference of the needleless type moving pin 730, and a needleless type flange 733 which is a flange-shaped member provided at an outer circumference of the needleless type roller body 731. More specifically, an outer diameter D30 of the needleless type moving pin 730 of the needleless type moving roller 73 is smaller than the groove width W1 of the guide groove 52 (outer diameter D30<groove width W1). In addition, an outer diameter D31 of the needleless type flange 733 of the needle type moving roller 93 is larger than the groove width W1 of the guide groove 52 (groove width W1<outer diameter D31). The needleless type flange 733 is provided at a side of the lower surface 513 of the support plate 51. Further, the needleless type flange 733 restricts the needleless type moving roller 73 from tilting with respect to the support plate 51, and in other words, the needleless type flange 733 restricts the needleless type binding unit 70 from tilting with respect to the support plate 51.

Next, the needleless type guide pin 78 will be described. As illustrated in FIG. 8, the needleless type guide pin 78 is provided as a part of the upper unit 701. More specifically, the needleless type guide pin 78 is provided in the form of a projection that protrudes toward the upper surface 511 from a frame body 702 which is provided on a portion of the upper unit 701 which faces the upper surface 511.

Next, the needleless type wheels 79 will be described. As illustrated in FIG. 7, the needleless type wheels 79 include a first needleless type wheel 791, a second needleless type wheel 792, a third needleless type wheel 793, and a fourth needleless type wheel 794, each of which is an approximately disk-shaped member provided to be rotatable. In the needleless type binding unit 70 disposed in the common groove 521, a rotational axis of each of the first to fourth needleless type wheels 791 to 794 is disposed in the transport direction. In addition, the first needleless type wheel 791 and the second needleless type wheel 792 are provided to be closer to the transport direction approaching side than the common groove 521 is to the transport direction approaching side, and the third needleless type wheel 793 and the fourth needleless type wheel 794 are provided to be closer to the transport direction retracting side than the common groove 521 is to the transport direction retracting side. More specifically, the first needleless type wheel 791 is provided to face the third needleless type wheel 793 with the common groove 521 interposed between the first needleless type wheel 791 and the third needleless type wheel 793, and the second needleless type wheel 792 is provided to face the fourth needleless type wheel 794 with the common groove 521 interposed between the second needleless type wheel 792 and the fourth needleless type wheel 794. In addition, the first to fourth needle type wheels 991 to 994 are formed to have an equal dimension.

<Operation of Needleless Type Binding Unit 70>

Figure 9A:
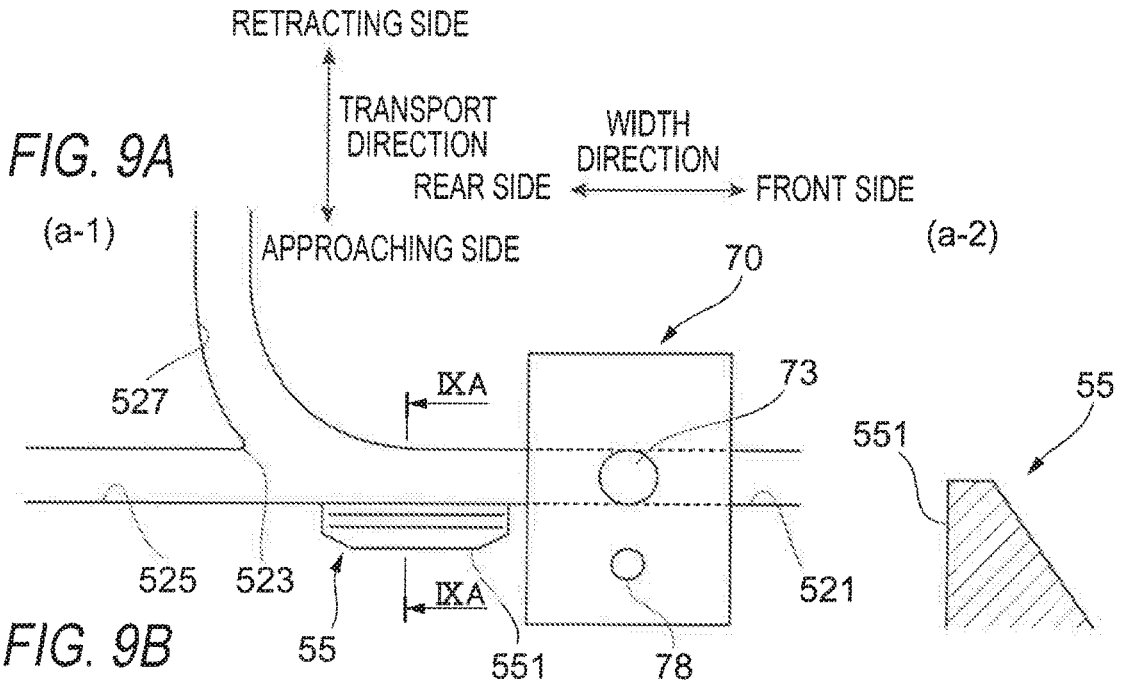
FIGS. 9A to 9C are views for explaining an operation of the needleless type binding unit.
Figure 9B:
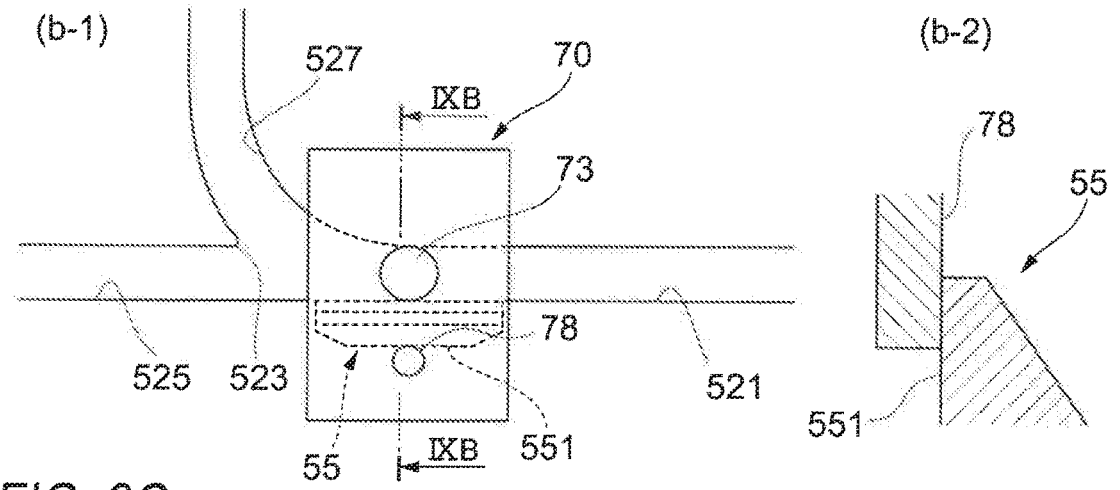
Figure 9C:
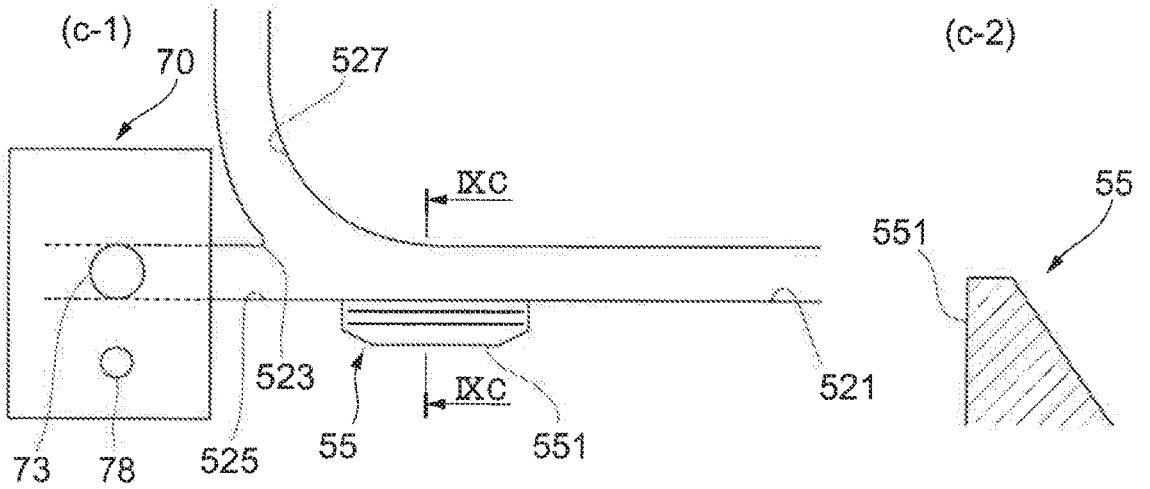

FIGS. 9A to 9C are views for explaining an operation of the needleless type binding unit 70.

Next, an operation of the needleless type binding unit 70 will be described with reference to FIG. 7 and FIGS. 9A to 9C.

First, as illustrated in FIG. 7, the needleless type moving roller 73 of the needleless type binding unit 70 is disposed in the guide groove 52, and the needleless type pinion gear 77 meshes with the needleless type rack 53. Further, the needleless type pinion gear 77 is rotated by receiving driving power of the needleless type motor 75, and the needleless type binding unit 70 is moved along the needleless type rack 53. In this case, the movement direction of the needleless type binding unit 70 is determined as the needleless type moving roller 73 is guided by the guide groove 52. Further, a distance between the needleless type pinion gear 77 and the needleless type rack 53 is stabilized (maintained) since the needleless type moving roller 73 is disposed in the guide groove 52. As a result, for example, the needleless type pinion gear 77 can be prevented from being spaced apart from the needleless type rack 53, or damage such as withdrawal of teeth of the needleless type pinion gear 77 and the needleless type rack 53 is inhibited.

Next, an operation of the needleless type binding unit 70, which moves from the common groove 521 to the needleless type groove 525 via the branching-off point 523, will be described with reference to FIGS. 9A to 9C. Further, the needleless type guide pin 78 engages with the needleless type guide body 55, which makes a pair with the needleless type guide pin 78, as the needleless type binding unit 70 moves, such that the direction of the needleless type binding unit 70 is controlled.

First, as illustrated in FIG. 9A, the needleless type moving roller 73 of the needleless type binding unit 70 is disposed in the common groove 521. In this case, as illustrated in FIG. 9A, the needleless type guide pin 78 is disposed to be closer to the width direction front side than the needleless type guide body 55 is to the width direction front side, and the needleless type guide pin 78 and the needleless type guide body 55 are spaced apart from each other.

As illustrated in FIG. 9B, the needleless type moving roller 73 of the needleless type binding unit 70 approaches the branching-off point 523. In this case, as illustrated in FIG. 9B, the needleless type guide pin 78 passes the needleless type guide body 55. In this case, the needleless type guide pin 78 travels along the first flat surface 551 by being guided by the first flat surface 551 of the needleless type guide body 55. Further, for example, the first flat surface 551 supports the needleless type guide pin 78 even though the needleless type binding unit 70 receives external force which allows the needleless type binding unit 70 to be directed toward the transport direction retracting side, that is, external force which allows the needleless type binding unit 70 to approach the needle type groove 527. Therefore, the needleless type binding unit 70 is inhibited from being moved (rotated) toward the needle type groove 527. That is, the needleless type binding unit 70 smoothly passes the branching-off point 523.

As illustrated in FIG. 9C, the needleless type moving roller 73 of the needleless type binding unit 70 passes the branching-off point 523 and then is disposed in the needleless type groove 525. In this case, as illustrated in FIG. 9C, the needleless type guide pin 78 is disposed to be closer to the width direction rear side than the needleless type guide body 55 is to the width direction rear side, and the needleless type guide pin 78 and the needleless type guide body 55 are spaced apart from each other.

Although a detailed description will be omitted, an operation of the needleless type binding unit 70, which moves to the common groove 521 from the needleless type groove 525 via the branching-off point 523, is performed in the order reverse to the order mentioned above. That is, the state illustrated in FIG. 9C is changed to the state illustrated in FIG. 9A via the state illustrated in FIG. 9B.

<Operation of Needle Type Binding Unit 90>

FIGS. 10A to 10D are views for explaining an operation of the needle type binding unit 90.

Next, an operation of the needle type binding unit 90 will be described with reference to FIG. 7 and FIGS. 10A to 10D.

First, as illustrated in FIG. 7, the needle type moving roller 93 of the needle type binding unit 90 is disposed in the guide groove 52, and the needle type pinion gear 97 meshes with the needle type rack 54. Further, the needle type pinion gear 97 is rotated by receiving driving power of the needle type motor 95, and the needle type binding unit 90 is moved along the needle type rack 54. In this case, the movement direction of the needle type binding unit 90 is determined as the needle type moving roller 93 is guided by the guide groove 52. Further, a distance between the needle type pinion gear 97 and the needle type rack 54 is stabilized (maintained) since the needle type moving roller 93 is disposed in the guide groove 52. As a result, for example, the needle type pinion gear 97 is inhibited from being spaced apart from the needle type rack 54, or damage such as withdrawal of teeth of the needle type pinion gear 97 and the needle type rack 54 is inhibited.

Next, an operation of the needle type binding unit 90, which moves from the common groove 521 to the needle type groove 527 via the branching-off point 523, will be described with reference to FIGS. 10A to 10D. Further, the needle type guide pins 98 engage with the needle type guide body 57, which makes a pair with the needle type guide pins 98, as the needle type binding unit 90 moves, such that the direction of the needle type binding unit 90 is controlled.

Figure 10A:
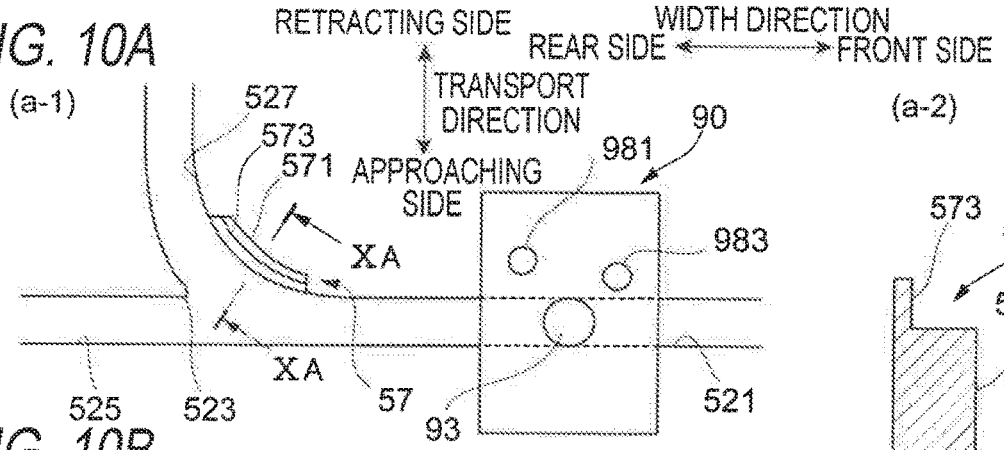
FIGS. 10A to 10D are views for explaining an operation of the needle type binding unit.

First, as illustrated in FIG. 10A, the needle type moving roller 93 of the needle type binding unit 90 is disposed in the common groove 521. In this case, as illustrated in FIG. 10A, the needle type guide pin 98 is disposed to be closer to the width direction front side than the needle type guide body 57 is to the width direction front side, and the needle type guide pin 98 and the needle type guide body 57 are spaced apart from each other.

Figure 10B:
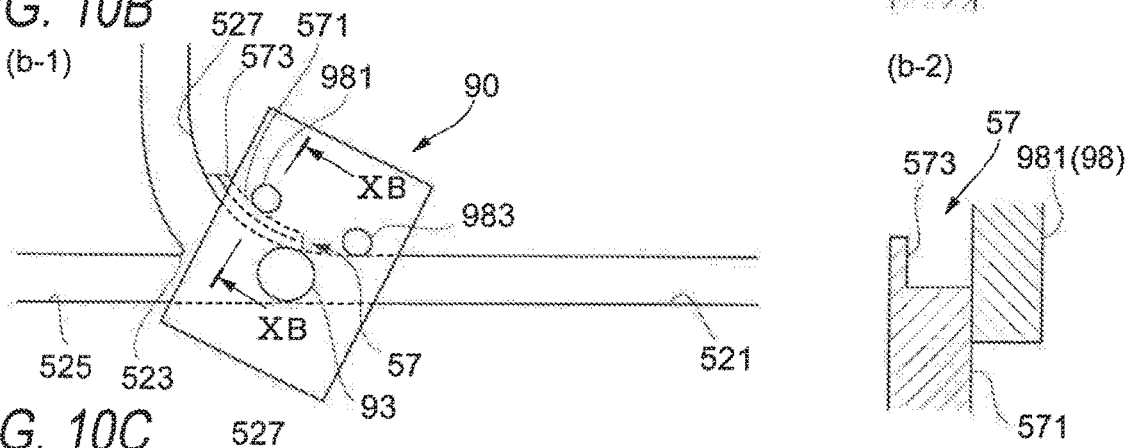

As illustrated in FIG. 10B, the needle type moving roller 93 of the needle type binding unit 90 approaches the branching-off point 523. In this case, as illustrated in FIG. 10B, the first needle type pin 981 of the needle type guide pins 98 hits against the first curved surface 571 of the needle type guide body 57, and travels along the first curved surface 571 by being guided by the first curved surface 571. Accordingly, the operation of rotating the needle type binding unit 90 toward the needle type groove 527 is assisted by the needle type guide body 57. In addition, for example, the first curved surface 571 supports the first needle type pin 981 even though the needle type binding unit 90 receives external force which allows the needle type binding unit 90 to be directed toward the transport direction approaching side, that is, external force which allows the needle type binding unit 90 to approach the needleless type groove 525. Therefore, the needle type binding unit 90 is inhibited from being moved (rotated) toward the needleless type groove 525.

Figure 10C:
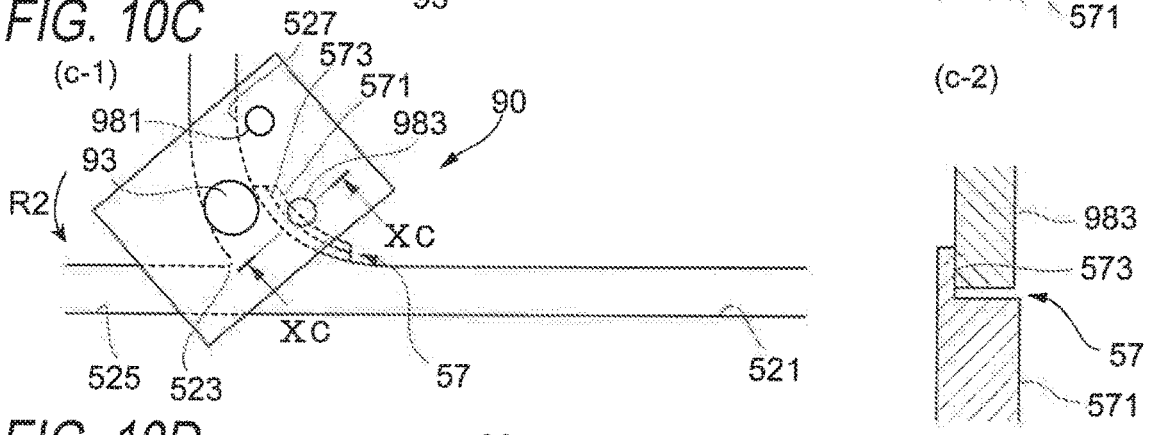

As illustrated in FIG. 10C, the needle type moving roller 93 of the needle type binding unit 90 passes the branching-off point 523. In this case, as illustrated in FIG. 10C, the second needle type pin 983 of the needle type guide pins 98 hits against the second curved surface 573 of the needle type guide body 57, and travels along the second curved surface 573. In this way, the needle type guide body 57 is further rotated. In addition, for example, the traveling direction of the needle type binding unit 90, which travels along the needle type groove 527, is inhibited from being rotated toward the needleless type groove 525 (see arrow R2 in the drawing). More specifically, the direction of the needle type binding unit 90, which travels along the needle type groove 527, is stabilized even after the first needle type pin 981 passes the needle type guide body 57.

Figure 10D:
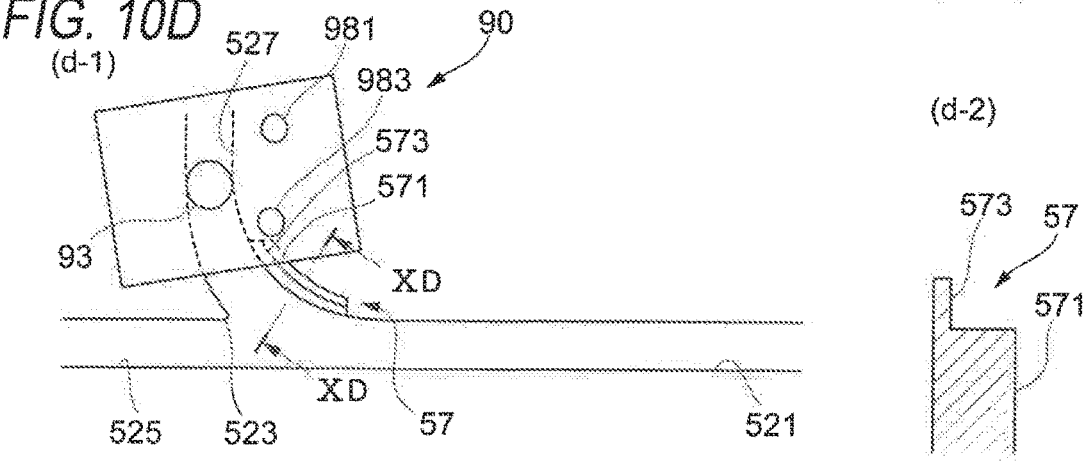

As illustrated in FIG. 10D, the needle type moving roller 93 of the needle type binding unit 90 passes the branching-off point 523 and then is disposed in the needle type groove 527. In this case, as illustrated in FIG. 10D, the needle type guide pin 98 is disposed to be closer to the transport direction retracting side than the needle type guide body 57 is to the transport direction retracting side, and the needle type guide pin 98 and the needle type guide body 57 are spaced apart from each other.

Although a detailed description will be omitted, an operation of the needle type binding unit 90, which moves from the needle type groove 527 to the common groove 521 via the branching-off point 523, is performed in the order reverse to the order mentioned above. That is, the state illustrated in FIG. 10D is changed to the state illustrated FIG. 10A via the state illustrated in FIG. 10C and the state illustrated in FIG. 10B.

<Operation of Needleless Type Binding Unit 70 and Operation of Needle Type Binding Unit 90>

As described above, the needleless type binding unit 70 moves from the common groove 521 to the needleless type groove 525, whereas the needle type binding unit 90 moves from the common groove 521 to the needle type groove 527. That is, traveling paths of the needleless type binding unit 70 and the needle type binding unit 90 are switched. Here, the traveling paths are switched as the needleless type guide pin 78 and the needleless type guide body 55, which are provided in a pair, engage with each other and as the needle type guide pins 98 and the needle type guide body 57, which are provided in a pair, engage with each other.

Here, in the illustrated configuration, for example, it is not necessary to provide a distribution valve or the like, which is a movable dividing member, inside the guide groove 52 and in the vicinity of the branching-off point 523 in order to switch the traveling paths of the needleless type binding unit 70 and the needle type binding unit 90. That is, the needleless type binding unit 70 and the needle type binding unit 90 are distributed to the needleless type groove 525 and the needle type groove 527, respectively, from the common groove 521 through which the needleless type binding unit 70 and the needle type binding unit 90 pass in common, without using a rail switching mechanism (switching control). Therefore, in comparison with the case in which the rail switching mechanism is used, the needleless type binding unit 70 and the needle type binding unit 90 are distributed at low costs by a simple mechanism including a combination of the needleless type guide pin 78 and the needleless type guide body 55 or a combination of the needle type guide pins 98 and the needle type guide body 57. Additionally, in the illustrated configuration, defective switching of the traveling paths, which is caused by malfunctions of electronic components, is inhibited. In addition, in the illustrated configuration, collisions between the binding units, which occur together with the defective switching of the traveling paths, are inhibited.

Here, the function of the needle type guide pins 98, which is omitted above, will be described. First, in the illustrated example as described above, the stacking plate 41 is provided to be inclined with respect to the horizontal direction. Further, the needle type binding unit 90 is also provided to be inclined in accordance with the stacking plate 41. In addition, since the upper unit 901 having the needle type binding piece (member) 91 and the like is heavy in weight, the needle type binding unit 90 easily tilts by its own weight (see arrow R1 in FIG. 6). Therefore, in the illustrated example, the needle type guide pins 98 (the first needle type pin 981 and the second needle type pin 983) are supported by the needle type binding unit 90 so that the needle type binding unit 90 is restricted from tilting.

In addition, if the needle type binding unit 90 tilts in the direction of arrow R1 in FIG. 6, the needle type pinion gear 97 provided on the lower unit 903 moves in a direction away from the needle type rack 54. In the illustrated example, the needle type guide pins 98 (the first needle type pin 981 and the second needle type pin 983) can prevent the needle type pinion gear 97 from being spaced apart from the needle type rack 54. In addition, if the needle type binding unit 90 tilts in a direction of arrow R1 in FIG. 6, the first needle type wheel 991 and the second needle type wheel 992 receive a larger load than the third needle type wheel 993 and the fourth needle type wheel 994.

Meanwhile, the needle type guide body 57 is provided at the width direction rear side of the guide groove 52 extending in the width direction, but no needle type guide body 57 is provided at the width direction front side (see FIG. 3). Here, as described above, the rear curved portion 527A of the needle type groove 527 has a larger curvature than the front curved portion 521B of the common groove 521. Therefore, higher force is required to rotate the needle type binding unit 90 when the needle type binding unit 90 passes through the rear curved portion 527A than when the needle type binding unit 90 passes through the front curved portion 521B. Therefore, in the illustrated example, the needle type guide body 57 is provided at the width direction rear side of the guide groove 52. Additionally, since the needle type guide body 57 is provided, the movement of the needle type binding unit 90 is not hindered even though the rear curved portion 527A has a large curvature. Further, a dimension of the periphery of the rear curved portion 527A may be inhibited by increasing the curvature as described above.

The needle type groove 527 is more greatly curved (has a larger curvature) than the needleless type groove 525. Therefore, in the illustrated example, the needle type binding unit 90, which is lighter in weight, is configured to be guided by the needle type groove 527 which is a more greatly curved route. In this way, since the needle type binding unit 90 is guided by the needle type groove 527, the movement of the needle type binding unit 90 is easily stabilized in comparison with the case in which the needleless type binding unit 70 is guided by the needle type groove 527. In addition, a driving mechanism of the needleless type binding unit 70 may be simplified. Here, to simplify the driving mechanism, for example, driving power required to be supplied is reduced or the number of components of the driving mechanism or a dimension of the driving mechanism is inhibited. Additionally, the needle type groove 527 extends upward in the vertical direction when viewed from the branching-off point 523. Therefore, in the illustrated example, the needle type binding unit 90, which is lighter in weight, is configured to be guided by the needle type groove 527. In this way, the driving mechanism may be simplified in comparison with the case in which the needleless type binding unit 70 is guided by the needle type groove 527.

As described above with reference to FIG. 8 and FIGS. 9A to 9C, in the needleless type binding unit 70 which is heavier in weight, the needleless type guide pin 78 passes a vertical direction lower side (transport direction approaching side) of the needleless type guide body 55. Further, the guide pin 78 comes into contact with the needleless type guide body 55 from the vertical direction lower side (transport direction approaching side). Meanwhile, in the needle type binding unit 90 which is lighter in weight, the needle type guide pins 98 (the first needle type pin 981 and the second needle type pin 983) pass a vertical direction upper side (transport direction retracting side) of the needle type guide body 57. Further, the needle type guide pins 98 come into contact with the needle type guide body 57 from the vertical direction upper side (transport direction retracting side). With this configuration, a load applied to the guide pin 78 of the needless type binding unit 70, which is heavier in weight, is reduced.

<Operation of Needle Type Wheel 99>

FIGS. 11A, 11B, 12A, 12B, 13A, and 13B are views for explaining an operation of the needle type wheels 99 of the needle type binding unit 90.

Next, an operation of the needle type wheels 99 of the needle type binding unit 90 will be described with reference to FIGS. 11A, 11B, 12A, 12B, 13A, and 13B. Here, an operation of the needle type wheels 99, when the needle type binding unit 90 moves from the common groove 521 to the needle type groove 527 via the branching-off point 523, will be described. Specifically, an operation of the first needle type wheel 991 and the second needle type wheel 992 of the needle type wheels 99, which move across the needleless type groove 525, will be described.

Figure 11B:
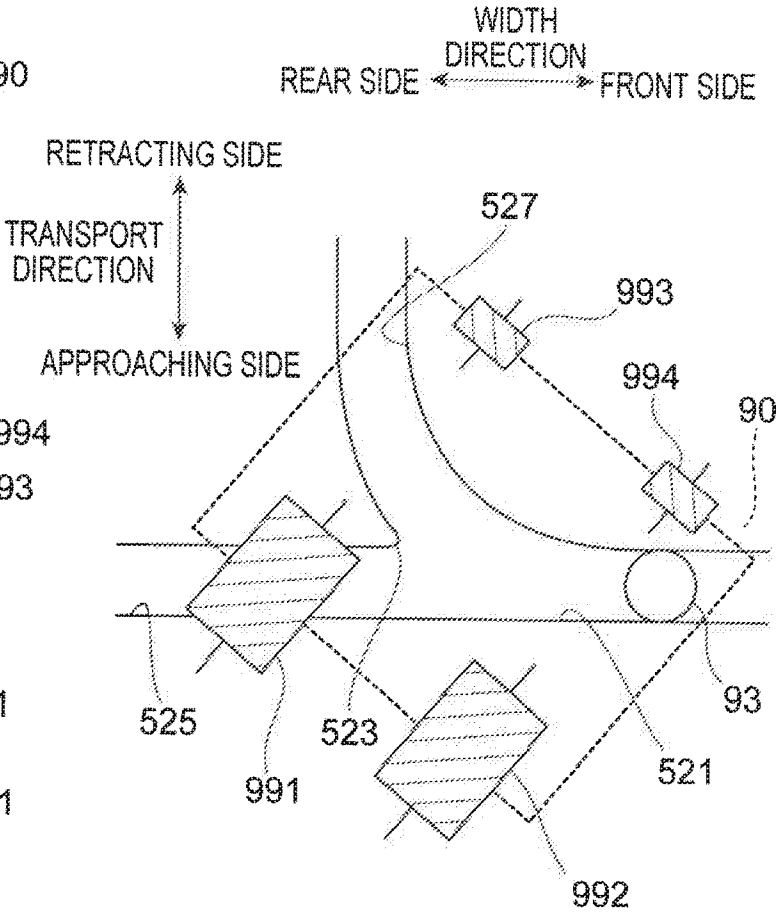
FIGS. 11A and 11B are views for explaining an operation of a needle type wheel in the needle type binding unit.
Figure 11A:
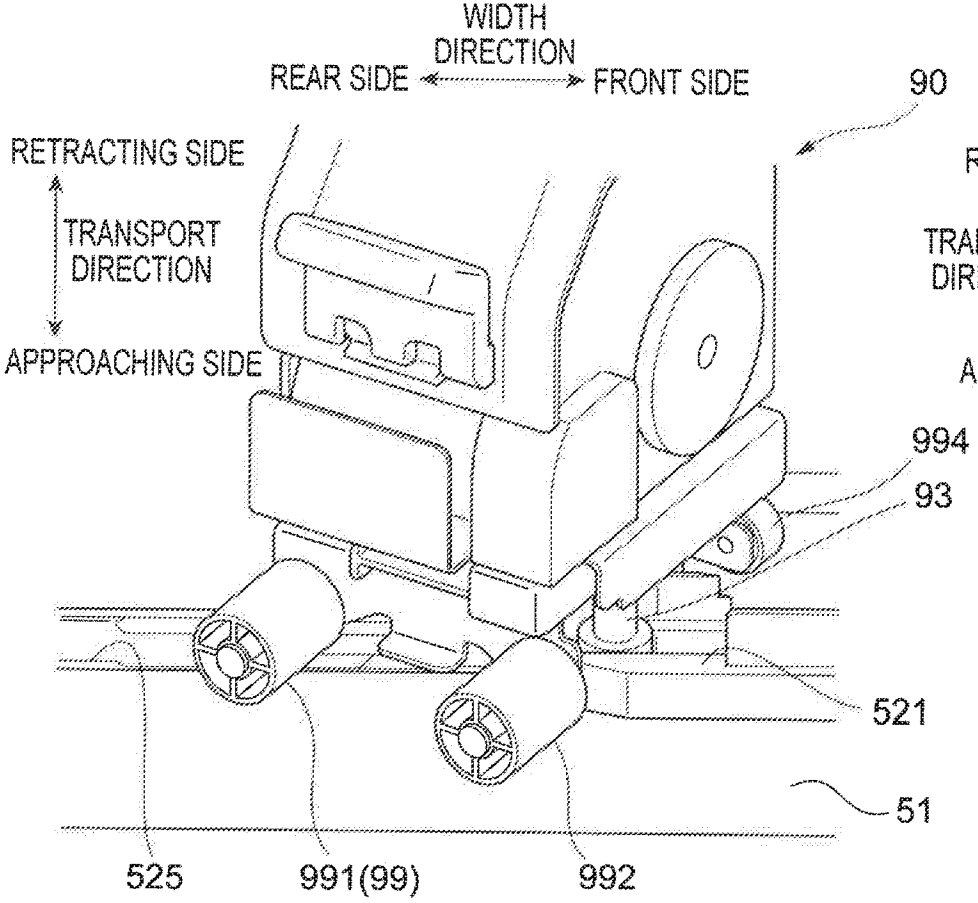

First, as illustrated in FIGS. 11A and 11B, the needle type moving roller 93 of the needle type binding unit 90 approaches the branching-off point 523 while moving in the common groove 521. In this case, the needle type binding unit 90 begins to rotate, and the first needle type wheel 991 begins to move across (begins to pass) the needleless type groove 525.

Figure 12B:
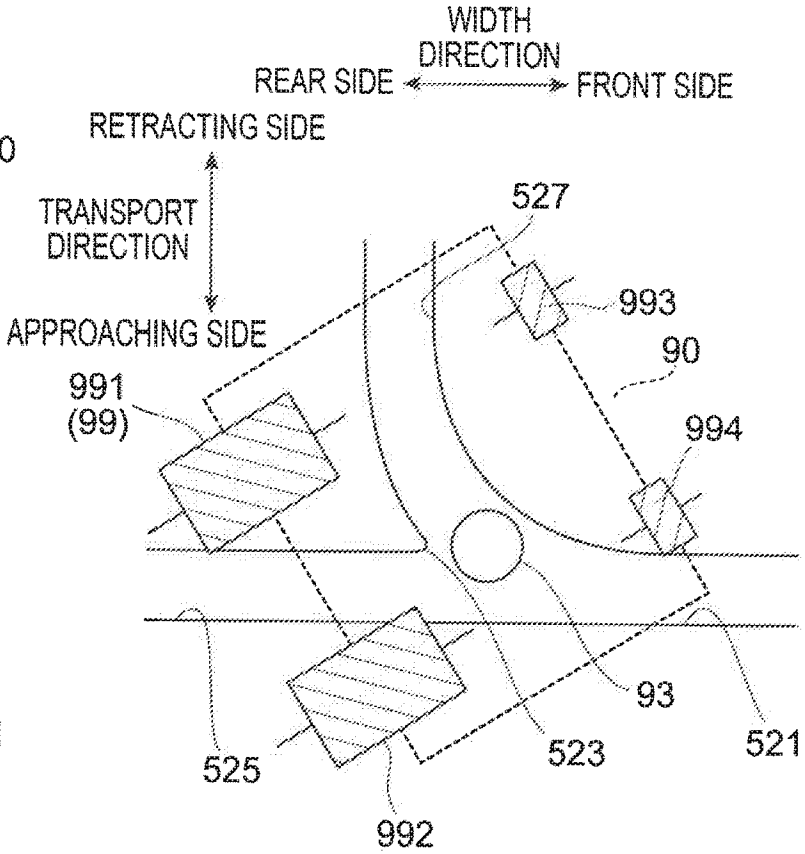
FIGS. 12A and 12B are views for explaining an operation of the needle type wheel in the needle type binding unit.
Figure 12A:
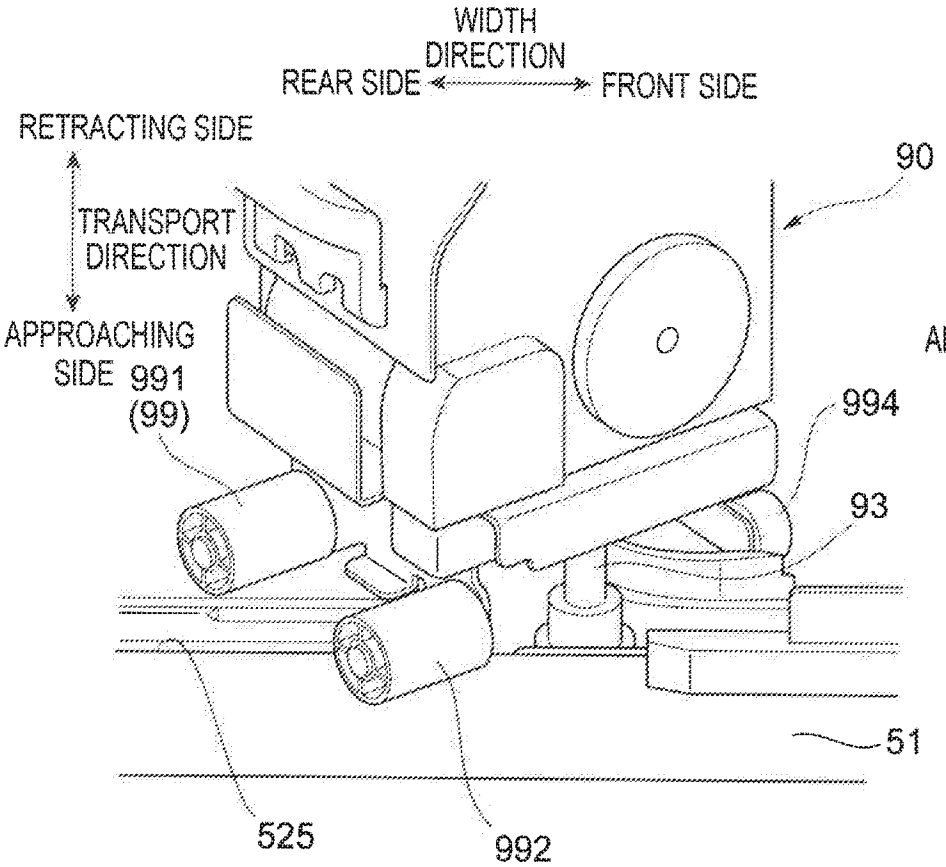

As illustrated in FIGS. 12A and 12B, the needle type moving roller 93 of the needle type binding unit 90 reaches the branching-off point 523. In this case, after the first needle type wheel 991 completely passes the needleless type groove 525, the second needle type wheel 992 begins to move across the needleless type groove 525.

Figure 13B:
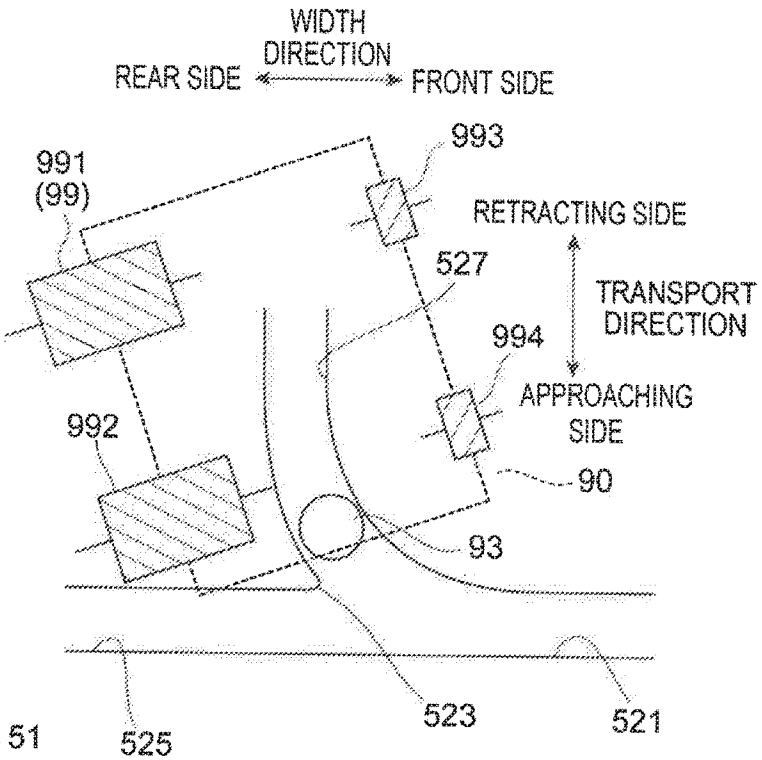
FIGS. 13A and 13B are views for explaining an operation of the needle type wheel in the needle type binding unit.
Figure 13A:
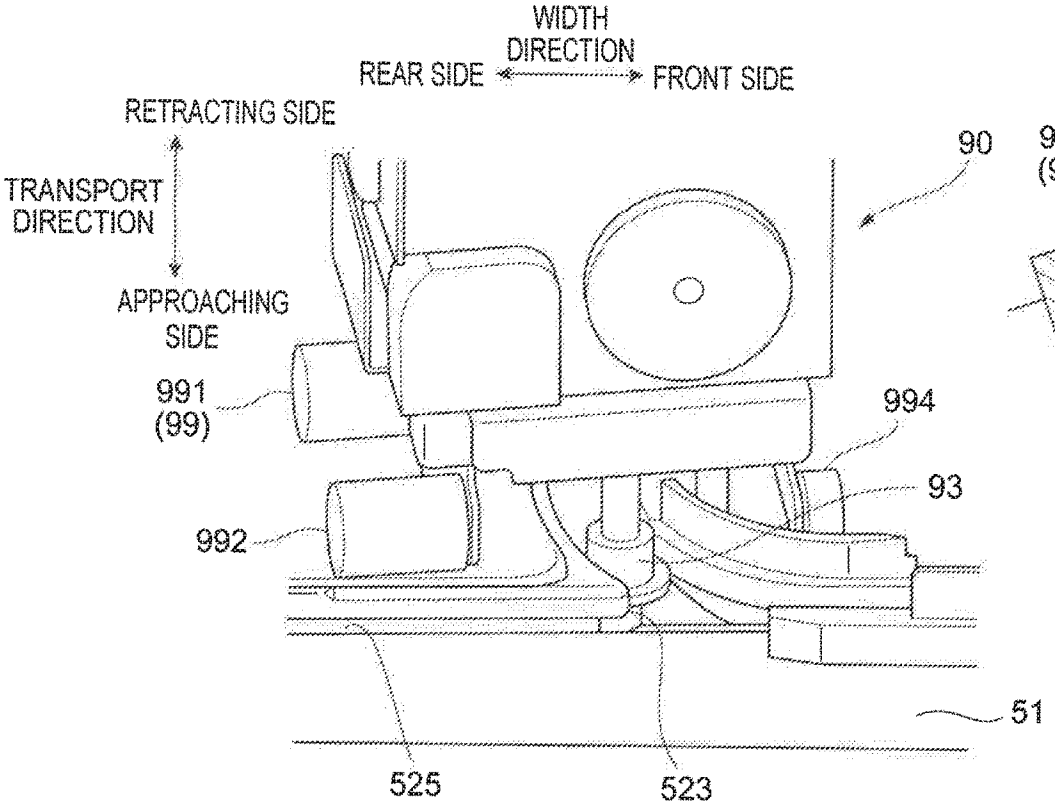

As illustrated in FIGS. 13A and 13B, the needle type moving roller 93 of the needle type binding unit 90 passes the branching-off point 523. In this case, the second needle type wheel 992 completely passes the needleless type groove 525.

<Dimension of First Needle Type Wheel 991 and Dimension of Second Needle Type Wheel 992>

Figure 14:
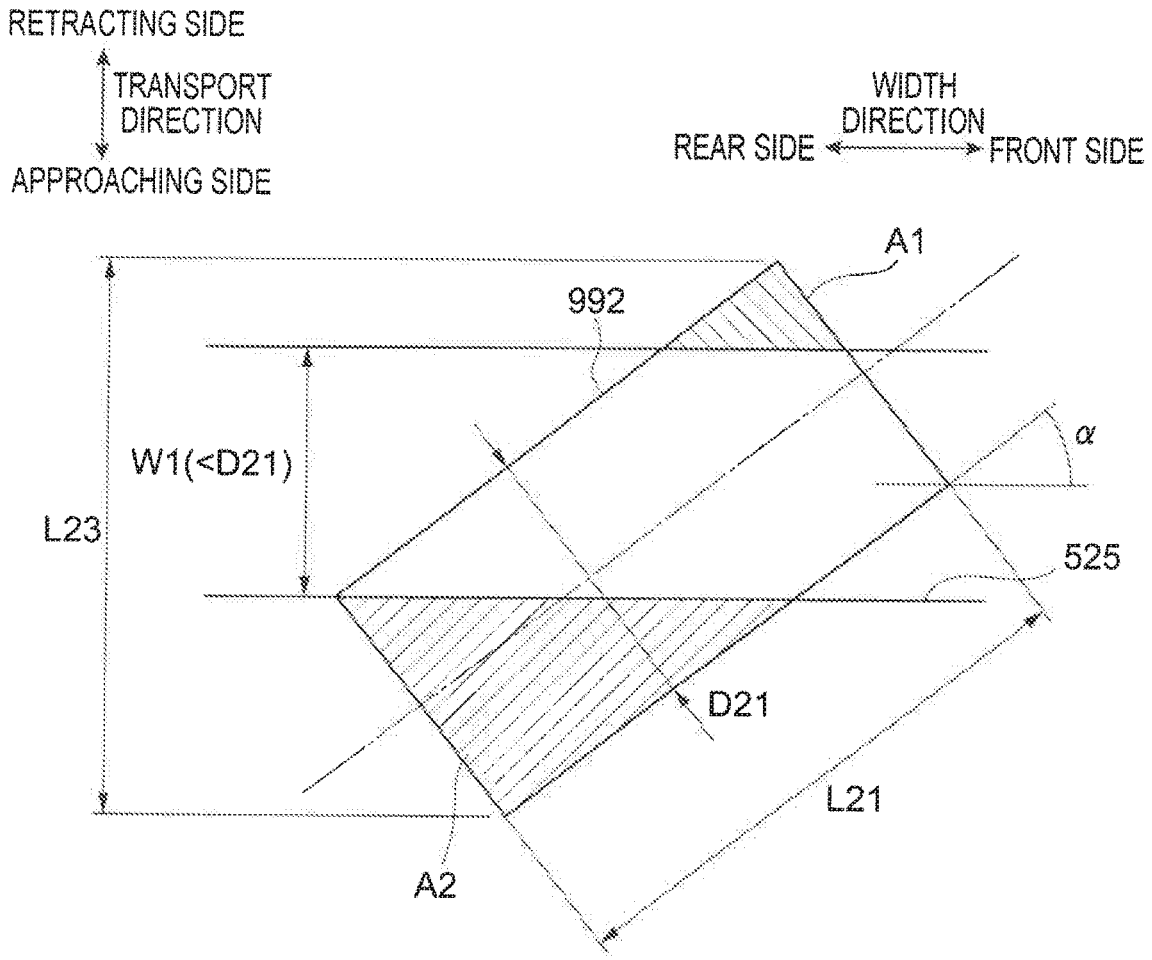
FIG. 14 is a view for explaining a dimension of a second needle type wheel.

FIG. 14 is a view for explaining a dimension of the second needle type wheel 992.

Next, a dimension of the first needle type wheel 991 and a dimension of the second needle type wheel 992 will be described with reference to FIG. 7 and FIGS. 14A and 14B.

As described above, the first needle type wheel 991 and the second needle type wheel 992 are formed to have dimensions that inhibit the first needle type wheel 991 and the second needle type wheel 992 from being inserted into the needleless type groove 525 when the first needle type wheel 991 and the second needle type wheel 992 pass across the needleless type groove 525. More specifically, the first needle type wheel 991 and the second needle type wheel 992 are formed to have dimensions that will restrict the first needle type wheel 991 and the second needle type wheel 992 from falling into the needleless type groove 525 in such a degree that the needle type binding unit 90 cannot move.

Here, the dimension of the second needle type wheel 992 will be specifically described. Further, only the second needle type wheel 992 will be described herein, but as described above, the first needle type wheel 991 and the second needle type wheel 992 are configured to have an equal dimension.

First, as described above, the axial length L21 of the second needle type wheel 992 is longer than an overall length of the fourth needle type wheel 994 (third needleless type wheel 993), that is, longer than the axial length L23 (see FIG. 7) (length L21>length L23). In addition, the outer diameter (wheel diameter) D21 of the second needle type wheel 992 is greater than the outer diameter D23 (see FIG. 7) of the fourth needle type wheel 994 (third needleless type wheel 993) (outer diameter D21>outer diameter D23).

The outer diameter D21 of the second needle type wheel 992 is greater than the groove width W1 of the needleless type groove 525 (groove width W1<outer diameter D21). Further, the length L23 of the second needle type wheel 992 in a direction in which the second needle type wheel 992 intersects the needleless type groove 525, that is, in the transport direction is greater than the groove width W1 (groove width W1<length L23).

The direction of the needle type binding unit 90 is changed when the second needle type wheel 992 passes across the needleless type groove 525. In this regard, an angle $\alpha$, which is formed by an axis of the second needle type wheel 992 and the needleless type groove 525, is also changed. Further, the illustrated second needle type wheel 992 is formed to have a dimension that allows the second needle type wheel 992 to simultaneously come into contact with both sides of the needleless type groove 525 in a groove width direction, that is, a dimension that enables the second needle type wheel 992 to move across the needleless type groove 525, when the angle $\alpha$ becomes the smallest angle. Here, in the case in which the second needle type wheel 992 is disposed to move across both sides of the needleless type groove 525 in the groove width direction, regions A1 and A2 of the second needle type wheel 992, which are positioned outside the needleless type groove 525, may be formed at both sides of the needleless type groove 525 in the groove width direction.

In addition, the second needle type wheel 992 has a greater outer diameter D21 as described above. Thus, the degree to which a part of the second needle type wheel 992 falls into (enters) the needleless type groove 525 will decrease even though the part of the second needle type wheel 992 falls into (enters) the needleless type groove 525. In other words, the degree to which the second needle type wheel 992 is inserted into the needleless type groove 525 will decrease. In this way, the second needle type wheel 992 is hardly inserted into the needleless type groove 525. In addition, the needle type binding unit 90 moves (travels) in flatwise.

Additionally, in the illustrated example, the needle type flange 933 is provided as described above. The needle type flange 933 restricts the needle type binding unit 90 from tilting when the second needle type wheel 992 moves across the needleless type groove 525. In addition, in the illustrated example, the derailment prevention mechanism is achieved by shape-optimizing the outer diameter or the axial length of the second needle type wheel 992 or providing the needle type flange 933, and as a result, it is possible to reduce manufacturing costs of the derailment prevention mechanism.

Modified Example

Figure 15A:
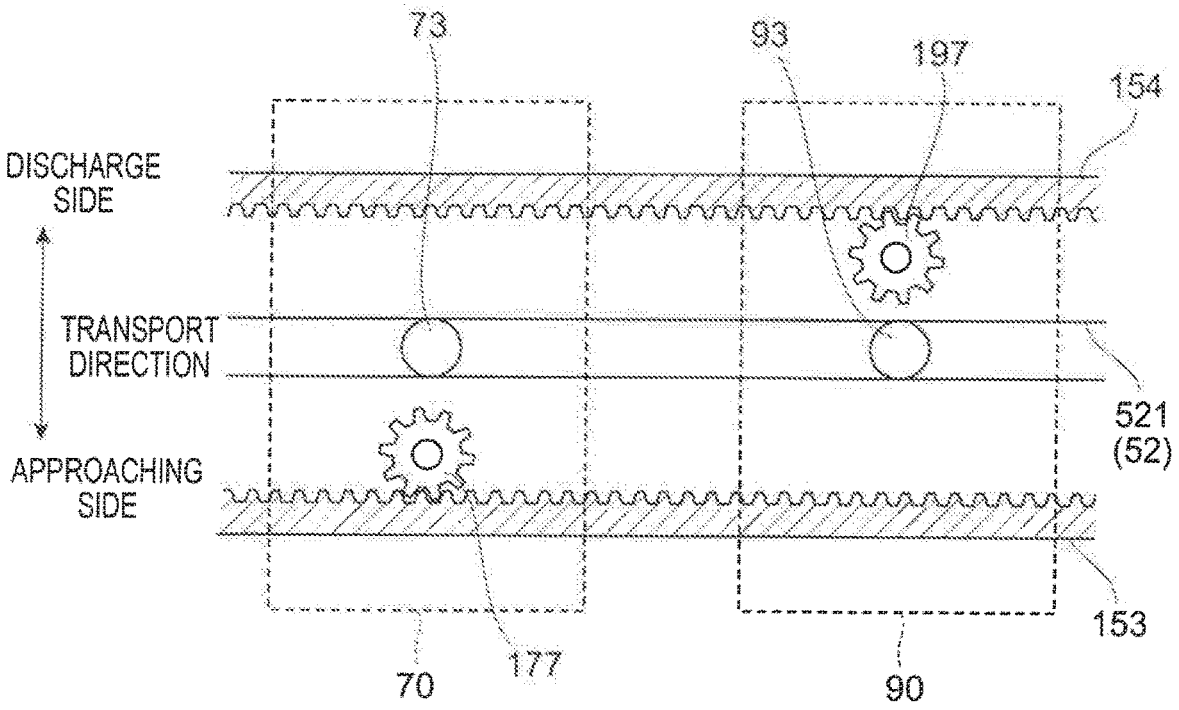
FIG. 15A is a view for explaining a needleless type rack and a needle type rack according to Modified Example 1.
Figure 15B:
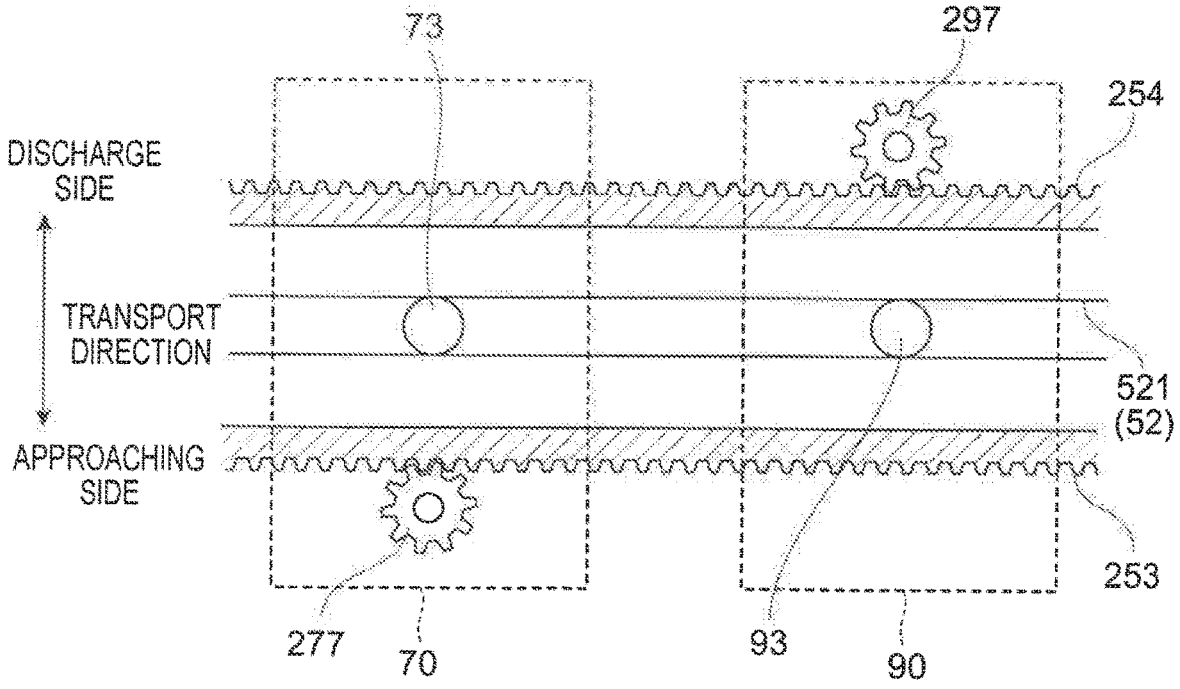
FIG. 15B is a view for explaining a needleless type rack and a needle type rack according to Modified Example 2.

FIG. 15A is a view for explaining a needleless type rack 153 and a needle type rack 154 according to Modified Example 1, and FIG. 15B is a view for explaining a needleless type rack 253 and a needle type rack 254 according to Modified Example 2.

Figure 16A:
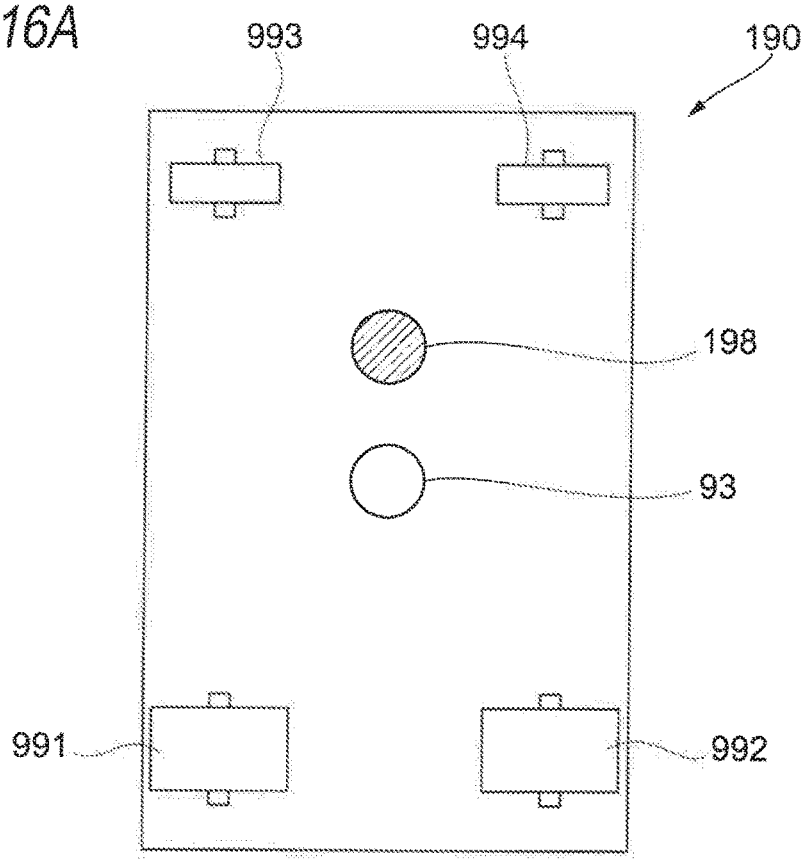
FIG. 16A is a view for explaining a needle type binding unit according to Modified Example 3.
Figure 16B:
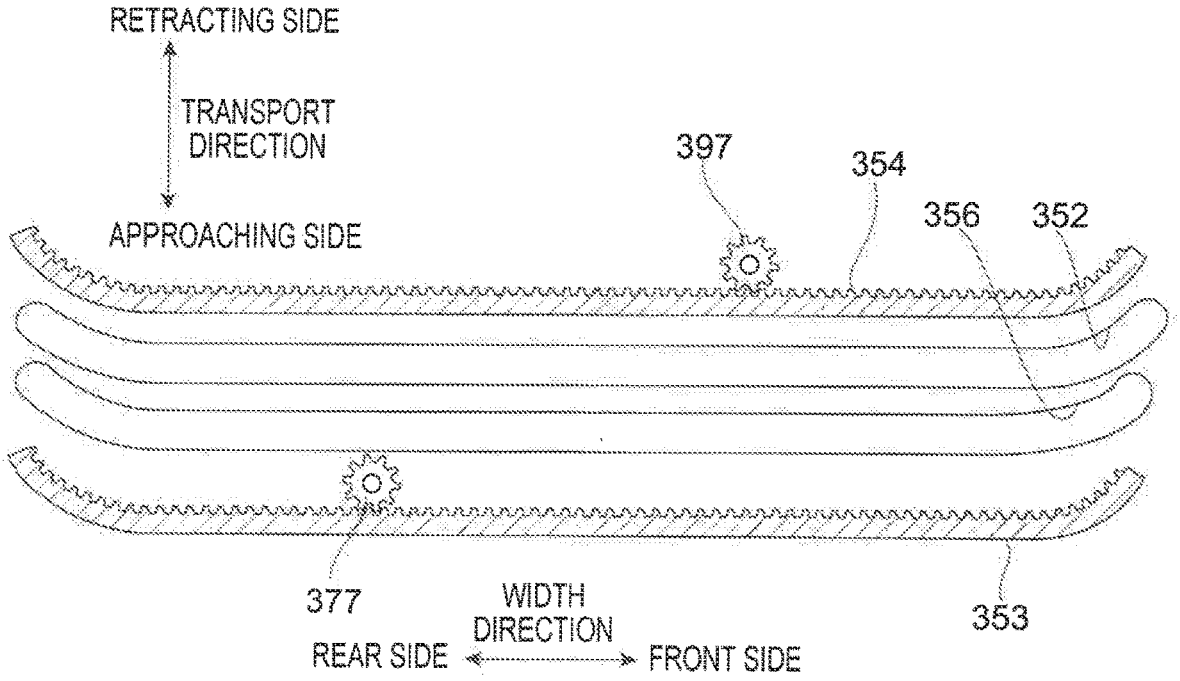
FIG. 16B is a view for explaining a needleless type rack and a needle type rack according to Modified Example 4.

FIG. 16A is a view for explaining a needle type binding unit 190 according to Modified Example 3, and FIG. 16B is a view for explaining a needleless type rack 353 and a needle type rack 354 according to Modified Example 4.

Next, the modified examples of the exemplary embodiment will be described with reference to FIGS. 15A, 15B, 16A, and 16B. Further, in FIGS. 15A, 15B, 16A, and 16B, parts identical to the parts in the exemplary embodiment are denoted by the same reference numerals, and detailed descriptions thereof will be omitted.

First, the configuration is described above in which the tooth surface of the needleless type rack 53 and the tooth surface of the needle type rack 54 are directed in the same direction, that is, toward the transport direction retracting side (vertical direction upper side), but the present disclosure is not limited thereto. For example, the tooth surface of the needleless type rack 53 and the tooth surface of the needle type rack 54 may be formed in different directions.

For example, as illustrated in FIG. 15A, a tooth surface of the needleless type rack 153 may be directed toward the transport direction retracting side, whereas a tooth surface of the needle type rack 154 may be directed toward the transport direction approaching side. Further, the needleless type rack 153 meshes with a needleless type pinion gear 177 positioned at the transport direction retracting side. In addition, the needle type rack 154 meshes with a needle type pinion gear 197 positioned at the transport direction approaching side.

As illustrated in FIG. 15B, a tooth surface of the needleless type rack 253 may be directed toward the transport direction approaching side, whereas a tooth surface of the needle type rack 254 may be directed toward the transport direction retracting side. Further, the needleless type rack 253 meshes with a needleless type pinion gear 277 positioned at the transport direction approaching side. In addition, the needle type rack 254 meshes with a needle type pinion gear 297 positioned at the transport direction retracting side.

Here, like the needleless type rack 153 illustrated in FIG. 15A, the tooth surface is configured to be directed toward the transport direction retracting side (vertical direction upper side), such that the needleless type rack 153 is disposed to support the needleless type pinion gear 177 that moves toward the transport direction approaching side by gravity. Therefore, a distance between the needleless type rack 153 and the needleless type pinion gear 177 is stabilized. Similarly, a distance between the needle type pinion gear 297 and the needleless type rack 254 illustrated in FIG. 15B is stabilized. Additionally, for example, the tooth surface of the rack, which moves the binding unit lighter in weight among the multiple binding units (the needleless type binding unit 70 and the needle type binding unit 90), may be configured to be directed toward the transport direction retracting side (vertical direction upper side), and the tooth surface of the rack, which moves the binding unit lighter in weight among the multiple binding units (the needleless type binding unit 70 and the needle type binding unit 90), may be configured to be directed toward the transport direction approaching side (vertical direction lower side).

Next, in the exemplary embodiment, the configuration is described in which the needle type binding unit 90 has the first needle type pin 981 and the second needle type pin 983 as the needle type guide pins 98, but the number of needle type guide pins 98 is not limited thereto. For example, like the needle type binding unit 190 illustrated in FIG. 16A, a single needle type guide pin 198 may be provided. In the illustrated example, the needle type guide pin 198 is provided at an approximately center of the needle type binding unit 190 in the width direction, but the position of the needle type guide pin 198 on the needle type binding unit 190 is not particularly limited.

In the exemplary embodiment, the configuration is described in which the needleless type binding unit 70 has the single needleless type guide pin 78, but the number of needleless type guide pins 78 is not limited thereto. Although not illustrated, the multiple needleless type guide pins 78 may be provided. In addition, in the above description, the configuration is described in which each of the needleless type guide pin 78 and the needle type guide pin 98 has an approximately columnar shape, but the shapes of the needleless type guide pin 78 and the needle type guide pin 98 are not particularly limited as long as the needleless type guide pin 78 and the needle type guide pin 98 are projections that engage with the needleless type guide body 55 and the needle type guide body 57.

In the exemplary embodiment, the configuration is described in which the guide groove 52 is divided, but the present disclosure is not limited thereto. In addition, the configuration is described in which both of the needleless type binding unit 70 and the needle type binding unit 90 pass through the common groove 521, but the present disclosure is not limited thereto.

For example, as illustrated in FIG. 16B, multiple guide grooves 352 and 356 may be formed along with each other. Further, the needleless type rack 353 and the needle type rack 354 may be provided along the guide grooves 352 and 356, respectively. Further, a needleless type pinion gear 377 and a needle type pinion gear 397 are disposed to mesh with the needleless type rack 353 and the needle type rack 354, respectively. Additionally, as illustrated in FIG. 16B, since the multiple guide grooves 352 and 356 are used by the needleless type rack 353 and the needleless type pinion gear 377 or the needle type rack 354 and the needle type pinion gear 397, respectively, the needleless type rack 353 and the needleless type pinion gear 377 and the needle type rack 354 and the needle type pinion gear 397 are inhibited from interfering with one another even when the multiple guide grooves 352 and 356 are disposed to be adjacent to each other.

In the exemplary embodiment, the configuration is described in which along the divided guide groove 52, the needleless type guide body 55 and the needle type guide body 57 are provided, and the needleless type rack 53 and the needle type rack 54 are provided, but the present disclosure is not limited thereto. For example, the needleless type guide body 55 and the needle type guide body 57 are provided along the divided guide groove 52, but the needleless type rack 53 and the needle type rack 54 may not be provided along the divided guide groove 52. More specifically, for example, the needleless type binding unit 70 and the needle type binding unit 90 may be driven by a mechanism, such as a timing belt, other than the needleless type rack 53 and the needle type rack 54. Alternatively, the needleless type rack 53 and the needle type rack 54 may be provided along the divided guide groove 52, but the needleless type guide body 55 and the needle type guide body 57 may not be provided along the divided guide groove 52. More specifically, movement destinations of the needleless type binding unit 70 and the needle type binding unit 90 may be switched by a mechanism other than the needleless type guide body 55 and the needle type guide body 57.

In the exemplary embodiment, the configuration is described in which the needle type groove 527 is curved toward the transport direction retracting side (vertical direction upper side) when viewed from the branching-off point 523, but the present disclosure is not limited thereto. For example, the needle type groove 527 may be curved toward the transport direction approaching side (vertical direction lower side) when viewed from the branching-off point 523. In addition, the needle type groove 527 may be formed rectilinearly without being curved. That is, both of the needleless type groove 525 and the needle type groove 527 may be formed rectilinearly.

In the exemplary embodiment, the configuration is described in which the support plate 51 is provided to be inclined with respect to the horizontal direction, but the present disclosure is not limited thereto. For example, a plate surface of the support plate 51 may be provided in the horizontal direction.

In the exemplary embodiment, the configuration is described in which both of the needleless type binding unit 70 and the needle type binding unit 90 are moved along the guide groove 52, but the present disclosure is not limited thereto. For example, only the needle type binding unit 90 may be provided in the guide groove 52 and only the needle type binding unit 90 may move along the guide groove 52. More specifically, only the needle type binding unit 90 may pass the curved portion and the branching-off point of the guide groove 52. Similarly, only the needleless type binding unit 70 may move along the guide groove 52.

In the exemplary embodiment, the configuration is described in which the needle type guide body 57 has the stepped portion, the first curved surface 571, and the second curved surface 573, but the present disclosure is not limited thereto. For example, the first curved surface 571 and the second curved surface 573 may be provided as independent members. In addition, the needle type guide body 57 may have no stepped portion, and the needle type guide body 57 may have a curved surface against which both of the first needle type pin 981 and the second needle type pin 983 hit. Further, as described above, the number of needleless type guide pins 78 may be 1. Therefore, the single needleless type guide pin 78 may hit against the needle type guide body 57 having no stepped portion.

In the exemplary embodiment, the configuration is described in which the first needle type wheel 991 and the second needle type wheel 992 have the dimensions that allow the first needle type wheel 991 and the second needle type wheel 992 to move across both sides of the needleless type groove 525 in the groove width direction. Here, the first needle type wheel 991 (second needle type wheel 992) may include multiple wheels. That is, the first needle type wheel 991 may include multiple wheels arranged in the axial direction on the needle type binding unit 90 disposed in the common groove 521. In addition, the first needle type wheel 991 may be composed of multiple small-diameter wheels arranged in the movement direction of the needle type binding unit 90. When the first needle type wheel 991 includes multiple small-diameter wheels as described above, the first needle type wheel 991 is restricted from falling into the needleless type groove 525, and the height of the first needle type wheel 991 from the upper surface 511 of the support plate 51 is decreased.

In the exemplary embodiment described above, the first needle type wheel 991 and the second needle type wheel 992 have dimensions larger than those of the third needle type wheel 993 and the fourth needle type wheel 994. However, any other configuration may be provided as long as the first needle type wheel 991 (second needle type wheel 992) is more restricted from falling into the needleless type groove 525 than the third needle type wheel 993 (fourth needle type wheel 994). For example, the first needle type wheel 991 may be lighter in weight than the third needle type wheel 993, or the outer circumferential surface of the first needle type wheel 991 may be made of a member that has a larger coefficient of friction than the outer circumferential surface of the third needle type wheel 993.

In the exemplary embodiment, the configuration in which both of the needleless type binding unit 70 and the needle type binding unit 90 are provided, but the present disclosure is not limited thereto. Any one of the needleless type binding unit 70 or the needle type binding unit 90 may be provided. In addition, the number of needleless type binding units 70 and the number of needle type binding units 90 are not particularly limited. Further, only the multiple needleless type binding units 70 or only the multiple needle type binding units 90 may be provided.

In the above description, the needle type binding unit 90 is an example of a first binding unit and a binding unit. The needleless type binding unit 70 is an example of a second binding unit.

The needle type pinion gear 97 is an example of a first gear. The needleless type pinion gear 77 is an example of a second gear. The common groove 521 is an example of a common path and a road. The needle type rack 54 is an example of a first rack gear and a rack gear. The needle type rack 53 is an example of a second rack gear. The needle type groove 527 is an example of a first path. The needleless type groove 525 is an example of a second path. The rear curved portion 527A is an example of a curved portion. The needle type guide body 57 is an example of a changing unit. The abutting portion 45 is an example of an alignment unit. The first needle type pin 981 is an example of a first protruding portion. The second needle type pin 983 is an example of a second protruding portion. The support plate 51 is an example of a guide body. The common groove 521 is an example of a movement path. The needle type groove 527 is an example of a retraction path. The image forming unit 13 is an example of an image forming unit. The sheet accommodating unit 11 is an example of a sheet feeding unit.

The needle type moving roller 93 and the needle type guide pin 98 are examples of a first projection and a projection. The needleless type moving roller 73 and the needleless type guide pin 78 are examples of a second projection. The needle type guide body 57 is an example of a first abutting body. The needleless type guide body 55 is an example of a second abutting body. The common groove 521 is an example of a common road and a road. The needle type groove 527 is an example of a first road and a retraction groove portion. The needleless type groove 525 is an example of a second road. The rear curved portion 527A is an example of a curved portion. The needle type motor 95 is an example of a first driving source. The needleless type motor 75 is an example of a second driving source. The needle type pinion gear 97 is an example of a first gear. The needleless type pinion gear 77 is an example of a second gear. The needle type rack 54 is an example of a first rack gear. The needle type rack 53 is an example of a second rack gear. The stacking plate 41 is an example of an inclined surface. The guide body 57 is an example of an abutting body.

The stacking plate 41 is an example of a loading unit. Similarly, the needle type binding unit 90 is an example of a binding unit. The needleless type binding unit 70 is an example of another binding unit. The common groove 521 and the needle type groove 527 are examples of a movement path and a road. The needleless type groove 525 is an example of another movement path. The rear curved portion 527A is an example of a curved portion. The first needle type pin 981 is an example of a first projection portion. The second needle type pin 983 is an example of a second projection portion. The needle type moving roller 93 is an example of a third projection portion. The first curved surface 571 is an example of a first abutting portion. The second curved surface 573 is an example of a second abutting portion.

The common groove 521 and the needle type groove 527 are examples of a first road. The needleless type groove 525 is an example of a second road. The needle type wheel 99 is an example of a rotating body. The second needle type wheel 992 is an example of a first rotating body. The fourth needle type wheel 994 is an example of a second rotating body. The needle type moving pin 930 is an example of a moving body. The needle type flange 933 is an example of a restriction mechanism. The rear curved portion 527A is an example of a curved portion. The needle type guide body 57 is an example of a changing unit. The needleless type guide body 55 is an example of an inhibition unit.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A post-processing apparatus comprising:

a first binding unit that binds sheets and moves while rotating a first gear;

a second binding unit that binds sheets and moves while rotating a second gear;

a common groove that is a groove along which the first binding unit and the second binding unit move;

a first rack gear that is provided along an exterior periphery of the common groove and meshes with the first gear outside of the common groove in a plan view so as to guide the first binding unit; and a second rack gear that is provided along an exterior periphery of the common groove at a side opposite to the first rack gear with the common groove interposed between the second rack gear and the first rack gear, and meshes with the second gear outside of the common groove in the plan view so as to guide the second binding unit.

2. The post-processing apparatus according to claim 1, further comprising:

an inclined surface on which sheets to be bound by at least one of the first binding unit or the second binding unit are stacked, wherein the first binding unit and the second binding unit are disposed to be inclined in accordance with the inclined surface, and either the first rack gear or the second rack gear that meshes with heavier one of the first binding unit or the second binding unit is disposed on a lower side in a vertical direction than the remaining one.

3. The post-processing apparatus according to claim 1, further comprising:

an inclined surface on which sheets to be bound by at least one of the first binding unit or the second binding unit are stacked, wherein the first binding unit and the second binding unit are disposed to be inclined in accordance with the inclined surface, and at least one of the first binding unit or the second binding unit is in contact with, from an upper side in a vertical direction, one of the first rack gear or the second rack gear that meshes with one of the first binding unit or the second binding unit.

4. The post-processing apparatus according to claim 1, further comprising:

a first groove that is provided to be continuous with the common groove through a branching-off point and is a groove along which the first binding unit moves;

a second groove that is provided to be continuous with the common groove through the branching-off point and is a groove along which the second binding unit moves;

an inclined surface on which sheets to be bound by at least one of the first binding unit or the second binding unit are stacked; and an alignment unit that aligns lower ends of sheets positioned at a lower side of the inclined surface by allowing the lower ends of the sheets to hit against the alignment unit, wherein the common groove and the second groove extend along the lower end, and the first groove extends from the common groove toward an upper side of the inclined surface through the branching-off point.

5. A post-processing apparatus comprising:

a first binding unit that binds sheets, has a first projection and a third projection, and moves;

a second binding unit that binds sheets, has a second projection and a fourth projection, and moves;

a common groove along which the first projection of the first binding unit and the second projection of the second binding unit move in common;

a first groove that is provided to be continuous with the common groove through a branching-off point and is a groove along which the first binding unit moves;

a second groove that is provided to be continuous with the common groove through the branching-off point and is a groove along which the second binding unit moves;

a first abutting body that protrudes with respect to the common groove and is provided in the vicinity of the branching-off point in a direction from the common groove to the first groove, and against which the first projection and the third projection hit opposing sides of the first abutting body; and a second abutting body that protrudes with respect to the common groove and is provided in the vicinity of the branching-off point in a direction from the common groove to the second groove, and against which the second projection and the fourth projection hit opposing sides of the second abutting body.

6. The post-processing apparatus according to claim 5, wherein the first groove has a curved portion that is curved and extends from the branching-off point, and the first abutting body is provided outside the common groove and the first groove and provided along an inner side of the curved portion of the first groove.

7. The post-processing apparatus according to claim 6, wherein the second abutting body is provided along an outer side of the common groove and disposed at an outer side opposite to the first groove across the common groove.

8. The post-processing apparatus according to claim 7, wherein the second abutting body has a portion that is disposed to be closer to the common groove than the curved portion.

9. A post-processing apparatus comprising:

a binding unit that binds sheets;

a movement groove that has a curved portion and is a groove along which the binding unit moves;

a first projection portion and a second projection portion that protrude from the binding unit, the first and second projection portions being disposed outside the movement groove;

a third projection portion that protrudes from the binding unit and is disposed within the movement groove;

a first abutting portion that is provided in the curved portion of the movement groove and against which the first projection portion hits to change a direction of the binding unit; and a second abutting portion against which the second projection portion hits to further change the direction of the binding unit that has been changed by the first abutting portion.

10. The post-processing apparatus according to claim 9, wherein the first abutting portion and the second abutting portion are disposed on the same side with respect to the movement groove.

11. The post-processing apparatus according to claim 10, further comprising:

another movement groove that branches off from a portion that is continuous with the curved portion of the movement groove, wherein the first abutting portion and the second abutting portion are disposed inside the curved portion.

12. The post-processing apparatus according to claim 10, wherein the first projection portion and the second projection portion are provided at different positions in a movement direction of the binding unit, and the first abutting portion is provided to be continuous with the second abutting portion.

13. The post-processing apparatus according to claim 12, wherein the second abutting portion against which the second projection portion hits is provided apart from a region through which the first projection portion passes.

14. The post-processing apparatus according to claim 9, wherein the binding unit binds sheets stacked on a stacking unit where the sheets are stacked, the apparatus further comprising:

another movement groove that branches off from a portion that is continuous with the curved portion of the movement groove; and another binding unit that is movable along the movement groove and the another movement groove and binds sheets stacked on the stacking unit, wherein the binding unit is restricted from moving to the another movement groove.

15. A post-processing apparatus comprising:

a binding unit that is movably provided and binds sheets;

a first groove that guides the binding unit;

a second groove that branches off from the first groove and guides the binding unit to a position different from a position to which the first groove is directed; and a plurality of rotating bodies that are provided on the binding unit with the first groove interposed therebetween, and move while rotating on a surface when the binding unit moves, wherein the rotating bodies include a first rotating body and a second rotating body provided with the first groove interposed between the first rotating body and the second rotating body, and an axial length of the first rotating body is longer than an axial length of the second rotating body.

16. The post-processing apparatus according to claim 15, wherein the first rotating body is formed to have a dimension that restricts the first rotating body from falling into the second groove when the binding unit passes a branching-off point between the first groove and the second groove.

17. The post-processing apparatus according to claim 16, wherein the first rotating body has an outer diameter greater than a width of the second groove.

18. The post-processing apparatus according to claim 16, wherein when passing the second groove in the direction intersecting the second groove, the first rotating body has a length greater than the width of the second groove in a width direction of the second groove.

19. The post-processing apparatus according to claim 16, wherein the binding unit has a moving body that moves in the first groove, and a restriction mechanism that is provided at an outer circumference of the moving body and restricts the moving body from tilting in the first groove.

* * * * *